US009698508B2

(12) United States Patent
Kobayashi et al.

(10) Patent No.: US 9,698,508 B2
(45) Date of Patent: Jul. 4, 2017

(54) CONNECTOR AND SUBSTRATE INTERCONNECTION STRUCTURE

(71) Applicant: IRISO ELECTRONICS CO., LTD., Kanagawa (JP)

(72) Inventors: Hiroaki Kobayashi, Kanagawa (JP); Yoshiyuki Ogura, Kanagawa (JP); Katsumasa Sato, Kanagawa (JP); Koji Kuniyoshi, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 10 days.

(21) Appl. No.: 15/086,259

(22) Filed: Mar. 31, 2016

(65) Prior Publication Data

US 2016/0294111 A1 Oct. 6, 2016

(30) Foreign Application Priority Data

Apr. 1, 2015 (JP) ..... 2015-075394

(51) Int. Cl.

| | |
|---|---|
| ***H01R 12/91*** | (2011.01) |
| ***H01R 12/71*** | (2011.01) |
| ***H01R 13/187*** | (2006.01) |
| ***H01R 13/502*** | (2006.01) |
| ***H01R 13/533*** | (2006.01) |
| *H01R 13/26* | (2006.01) |

(52) U.S. Cl.

CPC ..... *H01R 12/716* (2013.01); *H01R 12/91* (2013.01); *H01R 13/187* (2013.01); *H01R 13/502* (2013.01); *H01R 13/533* (2013.01); *H01R 13/26* (2013.01)

(58) Field of Classification Search

CPC ..... H01R 12/91; H01R 12/71; H01R 13/187; H01R 13/40; H01R 12/60

USPC .. 439/66, 83, 91, 591, 67, 79, 78, 640, 670, 439/717

See application file for complete search history.

(56) References Cited

U.S. PATENT DOCUMENTS 9,270,045 B2 * 2/2016 Kimura ..... H01R 13/41
9,466,907 B2 * 10/2016 Sakaue ..... H01R 24/60
(Continued)

FOREIGN PATENT DOCUMENTS

EP 0579053 A1 1/1994
EP 2835874 A1 2/2015
(Continued)

OTHER PUBLICATIONS

Search Report for European Patent App. No. 16162863/1 (Aug. 2, 2016).

*Primary Examiner* — Harshad Patel
(74) *Attorney, Agent, or Firm* — Cermak Nakajima & McGowan LLP; Tomoko Nakajima

(57) ABSTRACT

A plug connector electrically connected to a socket connector includes a movable housing engaged with the socket connector; a fixed housing secured to a first substrate; and a plug terminal having a plug contact portion in electrical contact with the socket connector engaged with the movable housing, and a movable part configured to support the fixed housing such that the fixed housing can be displaced with respect to the movable housing in engaging and disengaging directions of the socket connector with respect to the movable housing, while maintaining the contact of the plug contact portion with the socket connector.

10 Claims, 27 Drawing Sheets

(56) References Cited

U.S. PATENT DOCUMENTS

| | | | | |
|---|---|---|---|---|
| D775,084 | S * | 12/2016 | Sato | D13/147 |
| 2010/0297893 | A1 | 11/2010 | Masuda et al. | |
| 2011/0294326 | A1 | 12/2011 | Tanaka et al. | |
| 2013/0210270 | A1* | 8/2013 | Takeuchi | H01R 12/716 439/488 |
| 2015/0064935 | A1 | 3/2015 | Funayama et al. | |
| 2015/0132998 | A1 | 5/2015 | Sato | |
| 2015/0132999 | A1* | 5/2015 | Sato | H01R 24/60 439/676 |

FOREIGN PATENT DOCUMENTS

| | | | |
|---|---|---|---|
| EP | 2846409 | A2 | 3/2015 |
| JP | 07-282922 | A | 10/1995 |
| JP | 7-32878 | U | 6/1996 |
| JP | 2014-067706 | A | 4/2014 |
| JP | 5568677 | B1 | 6/2014 |

* cited by examiner

CONNECTOR AND SUBSTRATE INTERCONNECTION STRUCTURE

BACKGROUND OF THE INVENTION

1. Field of the Invention

The present invention relates to a connector configured to bring a substrate and a connection object into electrical contact, and also relates to a substrate interconnection structure including the connector.

2. Description of the Related Art

Among electric connectors including a connector electrically connected to a substrate and a connection object engaged with the connector are those in which terminals of the connector each have a movable part for absorbing vibration. The movable part is provided between a substrate connection portion secured to the substrate and a contact point in electrical contact with the connection object. When a vibration occurs, the movable part elastically deforms to absorb the vibration, thereby maintaining the electrical contact between the contact point and the connection object (see, e.g., Japanese Unexamined Utility Model Registration Application Publication No. 7-32878).

In such an electric connector, when a vibration occurs in a direction intersecting the mating and unmating directions (which may hereinafter be also referred to as engaging and disengaging directions) of the connector and the connection object, the movable part elastically deforms in the same direction as the vibration to absorb the vibration. On the other hand, in the case of a vibration in the mating and unmating directions, the movable part does not elastically deform in the mating and unmating directions. Instead, the terminals of the connector and the connection object slide with respect to each other in the mating and unmating directions, thereby absorbing the vibration to maintain the electrical contact between the connector and the connection object.

In this electric connector, repeated application of vibration in the mating and unmating directions may cause wear in sliding portions of terminals. In particular, when the surfaces of the terminals are plated for better electrical conductivity, the plating may come off because of the sliding with the connection object. This may degrade the reliability of connection between the connector and the connection object.

SUMMARY OF THE INVENTION

The present invention has been made against the background of the related art described above. An object of the present invention is to provide an electric connector in which, even when a vibration occurs along the mating and unmating directions of a connector and a connection object, the reliability of connection therebetween is not easily degraded.

The present invention is configured as follows to achieve the object described above.

The present invention can provide an electric connector that includes a first connector secured to a first substrate, and a second connector secured to a second substrate and engaged with the first connector. The first connector includes a first terminal having a first contact point and a first secured portion secured to the first substrate; and a first housing retaining the first terminal. The second connector includes a second terminal having a second contact point in pressure contact with the first contact point at a normal contact position in an engaged state with the first connector, and a second secured portion secured to the second substrate; and a second housing retaining the second terminal. In the electric connector, at least one of the first terminal and the second terminal has a movable part that elastically deforms such that the contact point at the normal contact position can be displaced in the mating and unmating directions of the first connector and the second connector. A load required for the elastic deformation of the movable part in the mating and unmating directions is smaller than a load required for relative positional displacement of at least one of the first contact point and the second contact point from the normal contact position in the mating and unmating directions.

The present invention can also provide an electric connector that includes a first connector secured to a first substrate and a connection object electrically connected to the first connector. The first connector includes a first terminal having a first contact point and a first secured portion secured to the first substrate, and a first housing retaining the first terminal. The connection object includes a contactor in pressure contact with the first contact point at a normal contact position in an engaged state with the first connector, and a second housing retaining the contactor. In the electric connector, at least one of the first terminal and the contactor has a movable part that elastically deforms such that the first contact point or the contactor at the normal contact position can be displaced in the mating and unmating directions of the first connector and the connection object. A load required for the elastic deformation of the movable part in the mating and unmating directions is smaller than a load required for relative positional displacement of at least one of the first contact point and the contactor from the normal contact position in the mating and unmating directions.

In either of the electric connectors described above, even when a vibration in the mating and unmating directions is applied to the terminal, the movable part can elastically deform in the mating and unmating directions to absorb the vibration.

If the load required for the elastic deformation of the movable part in the mating and unmating directions is greater than the load required for relative positional displacement of at least one of the first contact point and the second contact point from the normal contact position in the mating and unmating directions, when a vibration along the mating and unmating directions is applied to the terminal, the contact points are positionally displaced from each other before the elastic deformation of the movable part. In this case, the contact points slide with respect to each other and wear out, and their plating may come off.

In the present invention, however, the load required for the elastic deformation of the movable part in the mating and unmating directions is smaller than the load required for relative positional displacement of at least one of the first contact point and the second contact point from the normal contact position in the mating and unmating directions. Thus, when a vibration causes the housings to begin to be spaced apart from each other in at least one of the mating and unmating directions, the movable part elastically deforms before the contact points are positionally displaced from each other. Therefore, for example, when a load begins to be applied from one contact point to the other contact point in the mating and unmating directions, the movable part elastically deforms in the mating and unmating directions before the contact points are positionally displaced from each other. Thus, the movable part extends in the mating and unmating directions, thereby allowing the other contact point to follow the movement of the one contact point. It is thus possible to absorb the vibration while maintaining the electrical contact at the normal contact position without positional displacement between the one contact point and the other contact point. Since wear caused by sliding of the one contact point and the other contact point is unlikely to occur, the connection reliability is not easily degraded. Also, when a vibration occurs, the electrical connection between the contact points is maintained by their retaining force. Therefore, as compared to the case of maintaining the electrical contact of the terminal and the contactor using locking members or the like, fewer components are required and easier mating and unmating operation is achieved.

When the frequency of vibration reaches the natural frequency of the substrate, the resonance of the substrate may cause the connector to vibrate significantly. In this case, in the technique of the related art where the contact points slide with respect to each other, the distance available for the sliding is too short to absorb the significant vibration, and hence the electrical contact between the contact points may become unstable. In the present invention, however, even when such resonance occurs, the movable part elastically deforms sufficiently to cause one contact point to follow the displacement of the other contact point, thereby maintaining the electrical contact. A connector with high connection reliability can thus be provided. The same operations and advantageous effects as above can be achieved even when the first connector is not engaged with the second connector secured to the substrate, and is instead engaged with the connection object not secured to the substrate.

The present invention also provides a connector electrically connected to a connection object. The connector includes an engagement-side housing engaged with the connection object; a substrate-side housing secured to a substrate; and a first terminal having a first contact portion in electrical contact with the connection object engaged with the engagement-side housing, and a movable piece configured to support the substrate-side housing such that the substrate-side housing can be displaced with respect to the engagement-side housing in engaging and disengaging directions of the connection object with respect to the engagement-side housing, while maintaining the contact of the first contact portion with the connection object.

The present invention also provides a connector that includes a first connector and a second connector electrically connected to the first connector. The first connector includes an engagement-side housing engaged with the second connector; a substrate-side housing secured to a substrate; and a first terminal having a first contact portion in electrical contact with a second terminal of the second connector engaged with the engagement-side housing, and a movable piece configured to support the substrate-side housing such that the substrate-side housing can be displaced with respect to the engagement-side housing in engaging and disengaging directions of the second connector with respect to the engagement-side housing, while maintaining the contact of the first contact portion with the second terminal of the second connector.

If the substrate vibrates in the engaging and disengaging directions of the first connector and the second connector or connection object, the substrate-side housing is displaced in response to the vibration. However, in the connector of the present invention, the movable piece allows the substrate-side housing to be displaced with respect to the engagement-side housing. Since the movable piece can thus absorb the vibration, it is possible to maintain the electrical contact of the first contact portion with the second connector or connection object. Therefore, when the substrate vibrates in the engaging and disengaging directions of the connection object, it is possible to more effectively reduce wear of the terminals and absorb greater vibration than in the related art where vibration is absorbed only by sliding of the first contact portion with respect to the second connector or connection object.

In the connector according to the present invention, the engagement-side housing may have an abutting portion configured to abut against the substrate to which the substrate-side housing is secured.

In the connector according to the present invention, the engagement-side housing may have an abutting portion configured to abut against the substrate-side housing.

Thus, even when, in the engaging operation, the engagement-side housing is pressed toward the substrate or the substrate-side housing by the second connector or connection object, the abutting portion can abut against the substrate or the substrate-side housing to prevent excessive movement.

The present invention also provides a substrate interconnection structure including a first substrate; a second substrate disposed opposite the first substrate at a predetermined distance therefrom; a connector secured to the first substrate; and a connection object secured to the second substrate and electrically connected to the connector. The connector includes an engagement-side housing engaged with the connection object; a substrate-side housing secured to the first substrate; and a first terminal having a first contact portion in electrical contact with the connection object engaged with the engagement-side housing, and a movable piece elastically connecting the engagement-side housing to the substrate-side housing. When at least one of the first substrate and the second substrate warps in engaging and disengaging directions of the connection object with respect to the engagement-side housing, the movable piece elastically supports the substrate-side housing displaced in response to movement of the first substrate, while maintaining the contact of the first contact portion with the connection object.

It is thus possible to maintain the electrical contact between the first contact portion of the connector and the connection object while keeping the distance between the first and second substrates constant. When the first substrate or the second substrate vibrates in the engaging and disengaging directions of the connector and the connection object in this state, the substrate-side housing is displaced in response to the vibration. However, in the substrate interconnection structure of the present invention, the movable piece elastically supports the substrate-side housing such that it can be displaced, thereby absorbing the vibration.

In the substrate interconnection structure according to the present invention, the engagement-side housing may have an abutting portion configured to abut against the first substrate. One of the engagement-side housing and the connection object may have an engagement gap so that, when at least one of the first substrate and the second substrate warps in a direction of reducing the distance therebetween to cause the abutting portion of the engagement-side housing to be relatively pressed in by the first substrate, the engagement-side housing and the connection object are engaged with each other at a deeper position.

In the substrate interconnection structure according to the present invention, the engagement-side housing may have an abutting portion configured to abut against the substrate-side housing. One of the engagement-side housing and the connection object may have an engagement gap so that, when at least one of the first substrate and the second substrate warps in a direction of reducing the distance therebetween to cause the abutting portion of the engagement-side housing to be relatively pressed in by the substrate-side housing, the engagement-side housing and the connection object are engaged with each other at a deeper position.

With the engagement gap described above, even when at least one of the first substrate and the second substrate warps in the direction of reducing the distance therebetween, the engagement position of the engagement-side housing and the connection object is deepened accordingly, whereby the load applied to the engagement-side housing and the connection object by the warp of the substrate can be released.

The substrate interconnection structure according to the present invention may have a movement gap between the first substrate and the engagement-side housing.

The substrate interconnection structure according to the present invention may have a movement gap between the substrate-side housing and the engagement-side housing.

Thus, when the first connector and the connection object are in an engaged state, the engagement-side housing can be displaced toward the first substrate or the substrate-side housing in the direction of narrowing the movement gap.

In the substrate interconnection structure according to the present invention, the movable piece may elastically support the substrate-side housing displaced when at least one of the first substrate and the second substrate warps in a direction of increasing the distance therebetween.

Thus, even when at least one of the first substrate and the second substrate warps in the direction of increasing the distance therebetween, the electrical contact between the contact portions can be maintained.

In the substrate interconnection structure according to the present invention, the movable piece may elastically support the substrate-side housing displaced when at least one of the first substrate and the second substrate warps in a direction of reducing the distance therebetween.

Thus, even when at least one of the first substrate and the second substrate warps in the direction of reducing the distance therebetween, the electrical contact between the contact portions can be maintained.

The present invention can provide a connector in which, even when a vibration in the engaging and disengaging directions occurs, it is possible to maintain the electrical contact without wear of contact points. Also, with a substrate interconnection structure including this connector, the reliability of connection between substrates can be improved.

DESCRIPTION OF THE PREFERRED EMBODIMENTS

Figure 1:
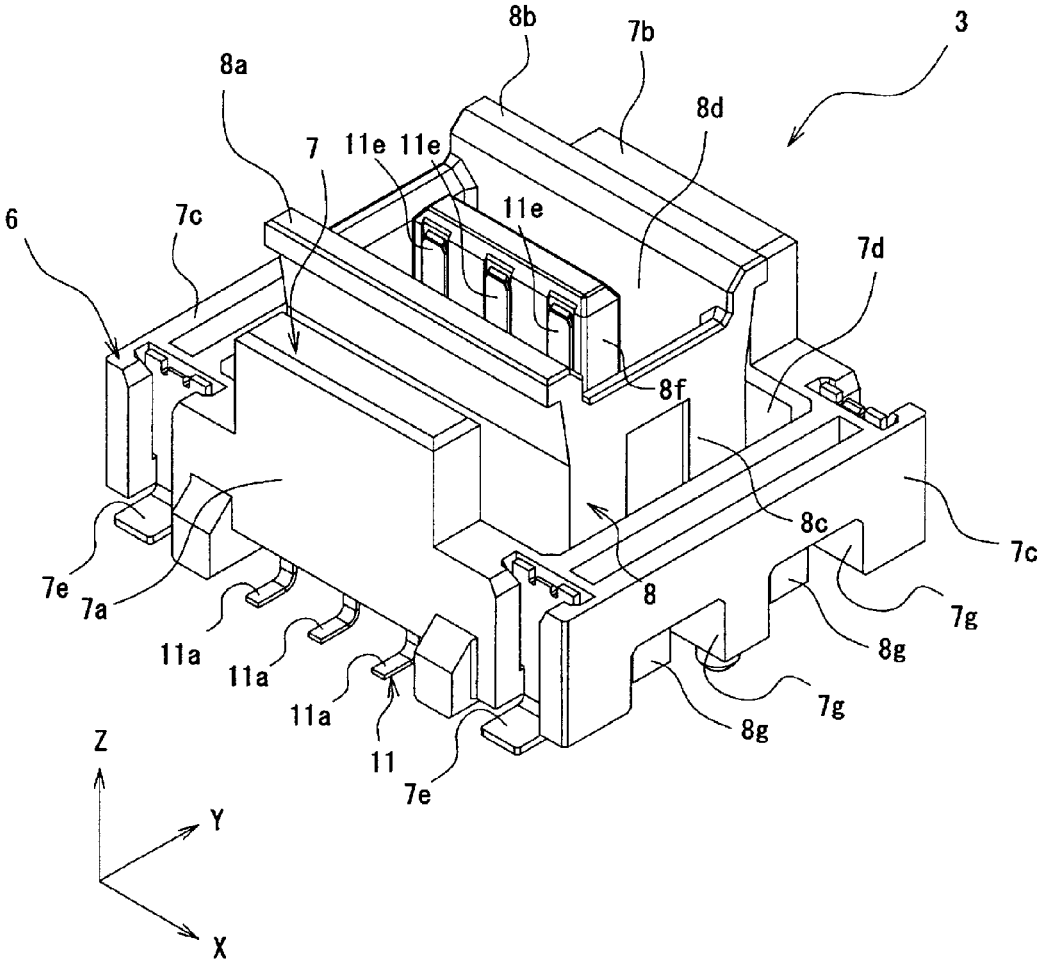
FIG. 1 is an external perspective view of a plug connector according to a first embodiment.
Figure 2:
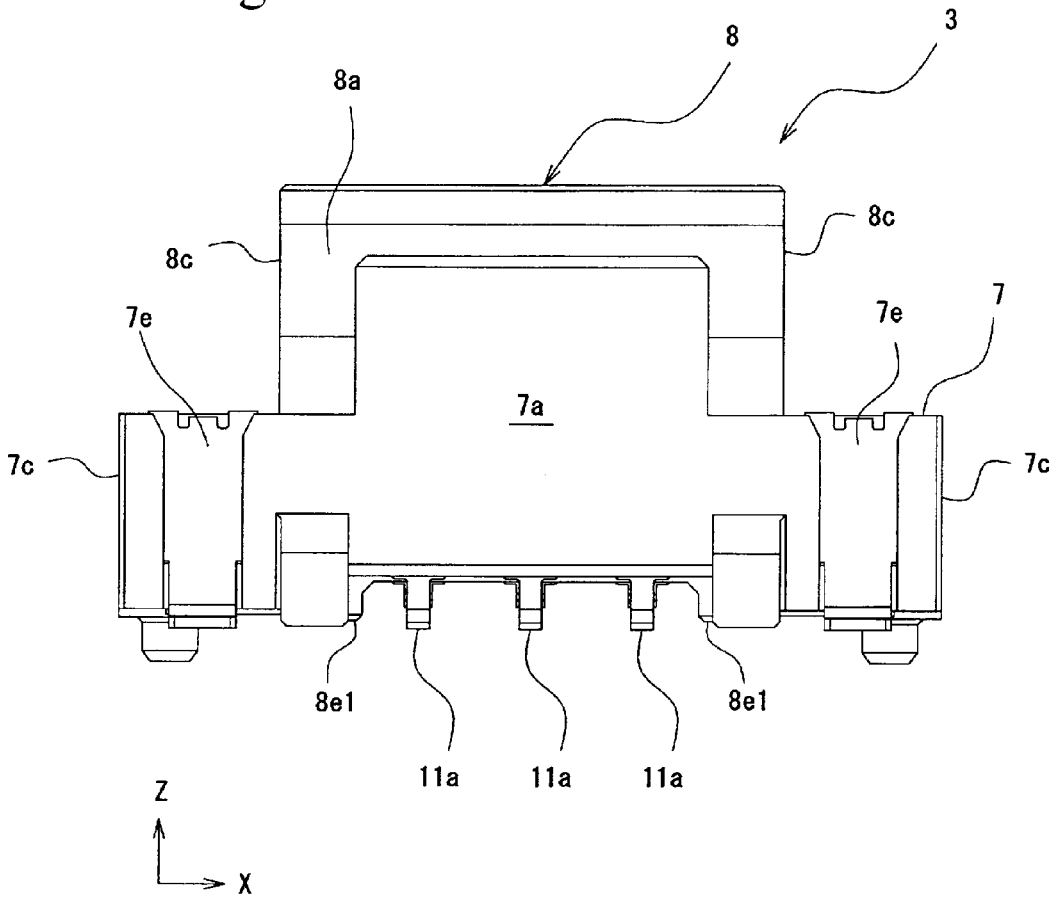
FIG. 2 is a front view of the plug connector illustrated in FIG. 1.
Figure 3:
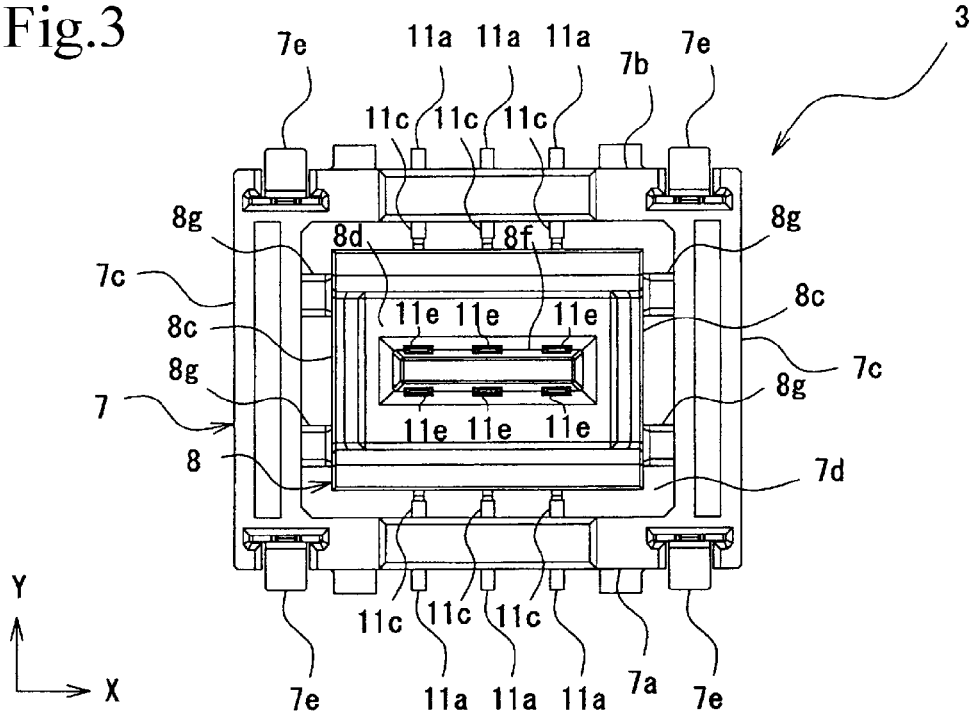
FIG. 3 is a plan view of the plug connector illustrated in FIG. 1.
Figure 4:
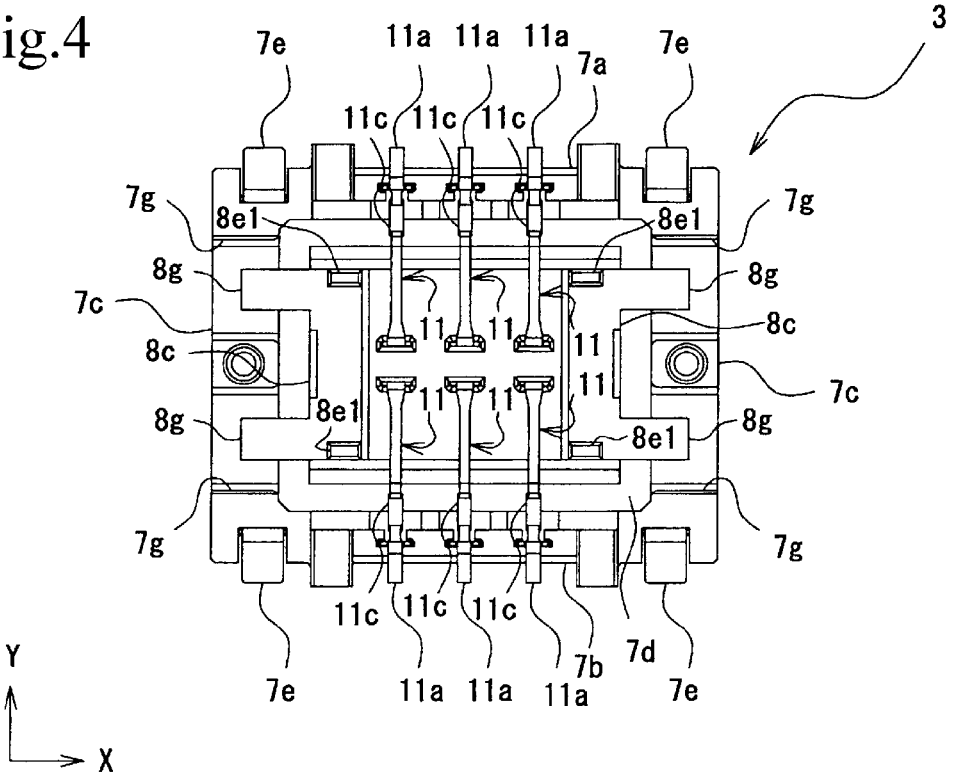
FIG. 4 is a bottom view of the plug connector illustrated in FIG. 1.

Embodiments of a connector according to the present invention will now be described with reference to the drawings. In the following description, components that are common to different embodiments are denoted by the same reference numerals and redundant description will be omitted. Redundant description of common applications and operational advantages will also be omitted.

In the present description, the width direction (longitudinal direction), front-back direction (shorter side direction), and height direction (up-down direction) of electric connectors 1, 21, and 41, each serving as a "connector", will be described as the X direction, Y direction, and Z direction, respectively. Also, a first substrate 2 and a second substrate 4 will be described as being on a "lower side" and an "upper side", respectively, in the height direction Z of the electric connectors 1, 21, and 41. Note that these definitions are not intended to limit the way of mounting the electric connectors 1, 21, and 41 on the substrates 2 and 4 and the application of the electric connectors 1, 21, and 41.

The back views of a plug connector 3, a socket connector 5, plug terminals 11, and socket terminals 10 will not be described, as they are identical to the front views. Also, their left side views will not be described, as the right and left side views are symmetrical.

First Embodiment (FIGS. 1 to 22)

Figure 16:
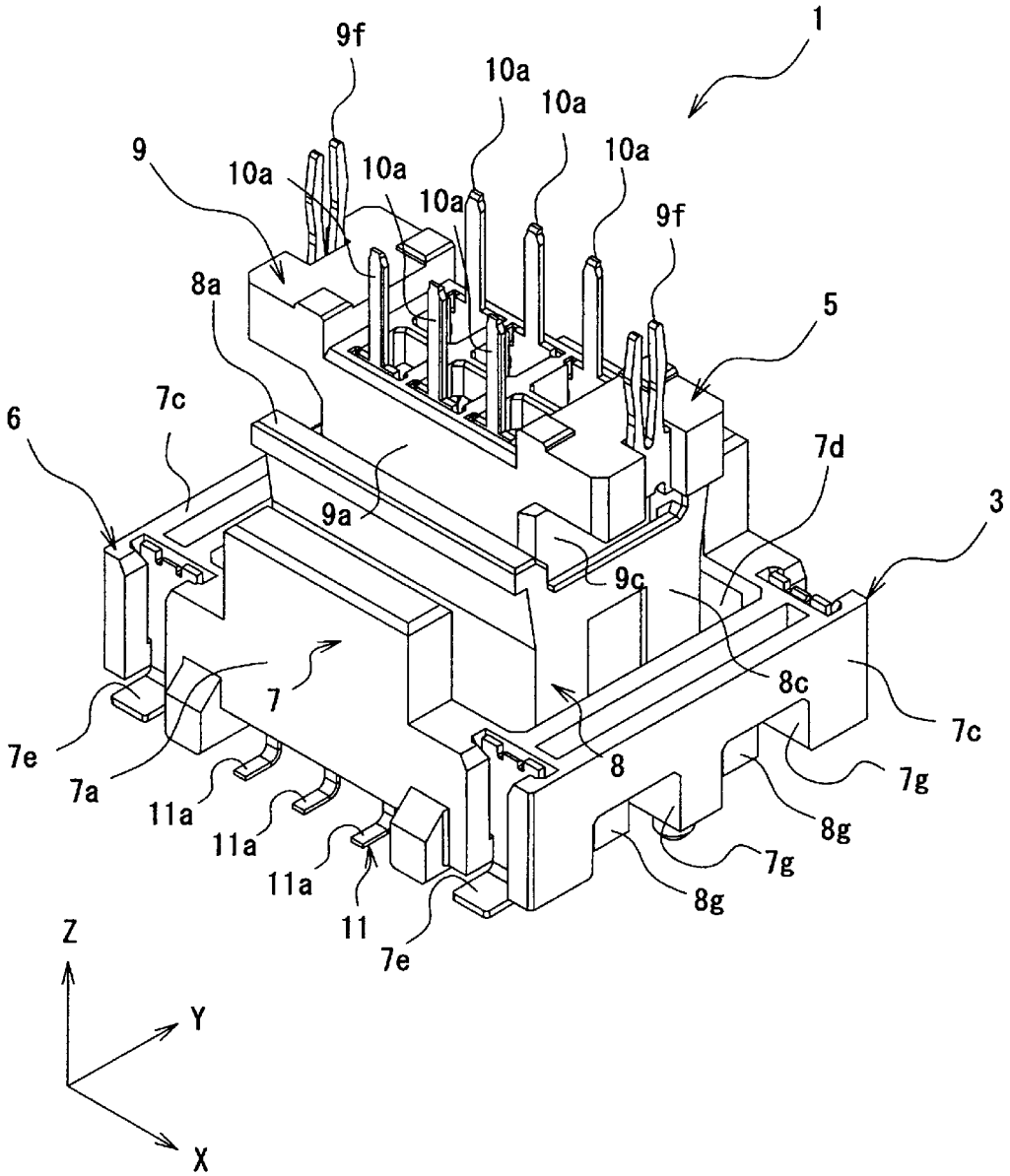
FIG. 16 is an external perspective view of the plug connector of FIG. 1 and the socket connector of FIG. 6 in an engaged state.

As illustrated in FIG. 16, the electric connector 1 of the first embodiment includes the plug connector 3 serving as a "first connector" mounted on the first substrate 2, and the socket connector 5 serving as a "second connector" or "connection object" mounted on the second substrate 4. The first substrate 2 and the second substrate 4 are electrically connected to each other by bringing the plug connector 3 and the socket connector 5 into engagement.

(Plug Connector)

As illustrated in FIGS. 1 to 5, the plug connector 3 of the present embodiment includes a plug housing 6 and the plug terminals 11 each serving as a "first terminal". The plug connector 3 is a surface mount connector. The plug connector 3 is electrically connected to the first substrate 2 by being mounted on a planar surface of the first substrate 2.

(Plug Housing)

The plug housing 6 is a molded component of insulating resin. The plug housing 6 is a floating connector including a fixed housing 7 serving as a "substrate-side housing" and a movable housing 8 serving as an "engagement-side housing".

The fixed housing 7 is in the shape of a rectangular cylinder which is open at the top and bottom thereof. The fixed housing 7 has a front portion 7*a* and a back portion 7*b* extending along the width direction X, and side portions 7*c* extending along the front-back direction Y. The fixed housing 7 has a movement space 7*d* surrounded by the front portion 7*a*, the back portion 7*b*, and the side portions 7*c*.

The planar surfaces of the front portion 7*a* and the back portion 7*b* facing the movement space 7*d* have terminal accommodating holes 7*a*1 and 7*b*1 (see FIG. 18) for securing the corresponding plug terminals 11. The terminal accommodating holes 7*a*1 and 7*b*1 are arranged in parallel, at regular intervals along the width direction X. The front portion 7*a* and the back portion 7*b* each are provided with fixtures 7*e* (see FIG. 3), at both ends thereof in the width direction X, for securing the plug connector 3 to the first substrate 2.

The movable housing 8 is in the shape of a box which is open at the top thereof. The movable housing 8 has a front portion 8*a*, a back portion 8*b*, side portions 8*c*, and a bottom portion 8*e* (see FIG. 18). The movable housing 8 also has an engagement wall 8*f* (see FIGS. 1, 3, and 5) protruding upward from the center of the bottom portion 8*e*. The engagement wall 8*f* of the movable housing 8 and plug contact portions 11*e* (described below) of the plug terminals 11 form an engaging part 3A (see FIG. 18) to be inserted into a receiving port 9*d*1 (see FIG. 6) of a socket housing 9. The bottom portion 8*e* has abutting portions 8*e*1 (see FIG. 4) abutting against the first substrate 2.

The engagement wall 8*f* is in the shape of a flat plate extending along the X-Z plane. The engagement wall 8*f* has a planar surface facing the front portion 8*a* and a planar surface facing the back portion 8*b*. Each of the planar surfaces has terminal grooves 8*f*2 (see FIG. 18) for accommodating the plug contact portions 11*e* of the plug terminals 11. The movable housing 8 has an engagement chamber 8*d* (see FIG. 18) for insertion of the socket connector 5 therein. The engagement chamber 8*d* is formed as a space surrounded by the front portion 8*a*, the back portion 8*b*, the side portions 8*c*, and the bottom portion 8*e*. The plug terminals 11 and the socket terminals 10 (described below) are brought into electrical contact with each other in the engagement chamber 8*d*.

(Plug Terminal)

The plug terminals 11 are formed by bending a conductive metal sheet in the sheet thickness direction. As illustrated in FIG. 11 and FIGS. 12A to 12E, the plug terminals 11 each have a substrate connection portion 11*a*, a fixed portion 11*b*, a movable part 11*c* serving as a "movable piece", a base end portion 11*d* secured to the movable housing 8, and the plug contact portion 11*e* serving as a "first contact portion". The plug terminals 11 form pairs of terminals opposite each other with the engagement wall 8*f* interposed therebetween (see FIG. 3).

The substrate connection portion 11*a* is located at an end of each plug terminal 11 and formed as a plate-like piece extending along the planar surface of the first substrate 2. The plug terminals 11 are secured to the first substrate 2 by soldering the substrate connection portions 11*a* to the first substrate 2.

The fixed portion 11*b* extends from the substrate connection portion 11*a* along the height direction Z. The fixed portion 11*b* has a plurality of press-fit protrusions 11*b*1 at both ends thereof in the width direction X. The fixed portions 11*b* are press-fitted into the terminal accommodating holes 7*a*1 and 7*b*1 (see FIG. 18) in the fixed housing 7, and the press-fit protrusions 11*b*1 are engaged in the inner walls (not shown) of the terminal accommodating holes 7*a*1 and 7*b*1, whereby the plug terminals 11 are secured to the fixed housing 7.

The movable part 11*c* has a plurality of bent portions bent in the sheet surface direction. Therefore, as compared to the case of having bent portions bent in the sheet edge direction, the movable part 11*c* is more elastically deformable in the bending or extending direction. Since the movable parts 11*c* are not secured to the plug housing 6, the movable parts 11*c* can be elastically deformed easily by a load applied thereto. The movable parts 11*c* elastically connect the movable housing 8 to the fixed housing 7 in the engaging and disengaging directions of the socket connector 5 with respect to the movable housing 8, and support the fixed housing 7 such that the fixed housing 7 can be displaced with respect to the movable housing 8.

Figure 11:
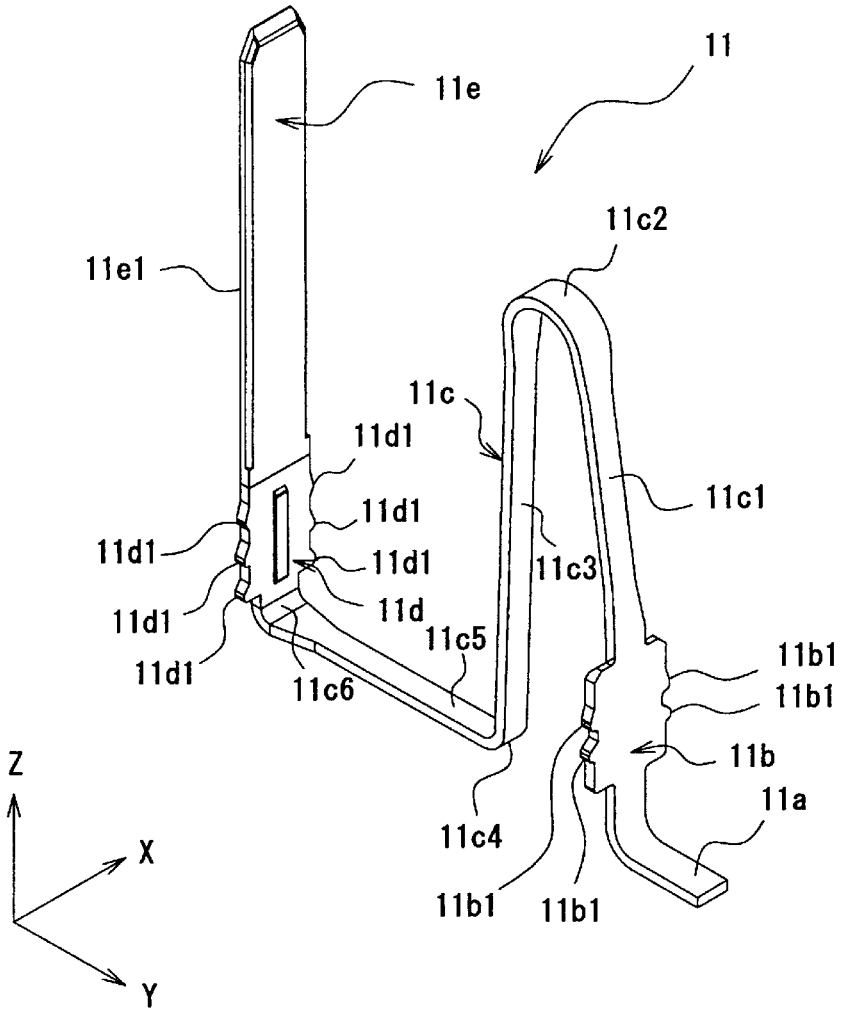
FIG. 11 is an external perspective view of a plug terminal illustrated in FIG. 1.
Figure 12A:
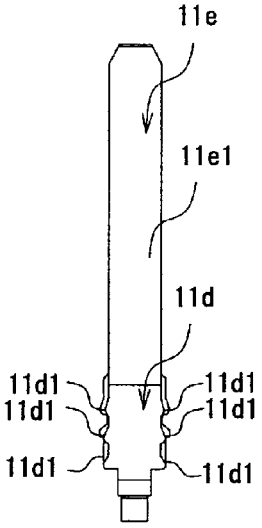
FIG. 12A is a front view of the plug terminal illustrated in FIG. 11.
Figure 12B:
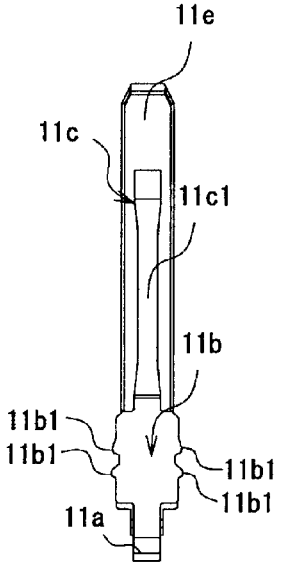
FIG. 12B is a back view of the same.
Figure 12C:
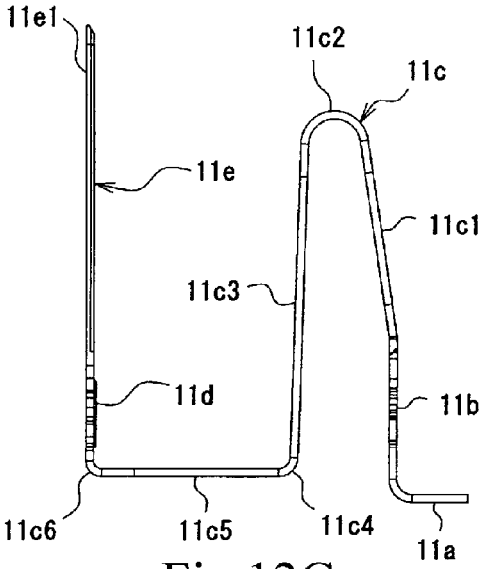
FIG. 12C is a right side view of the same.
Figure 12D:
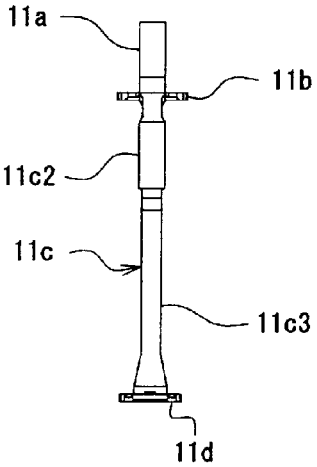
FIG. 12D is a plan view of the same.
Figure 12E:
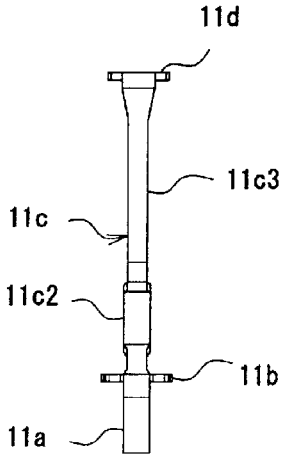
FIG. 12E is a bottom view of the same.
Figure 13:
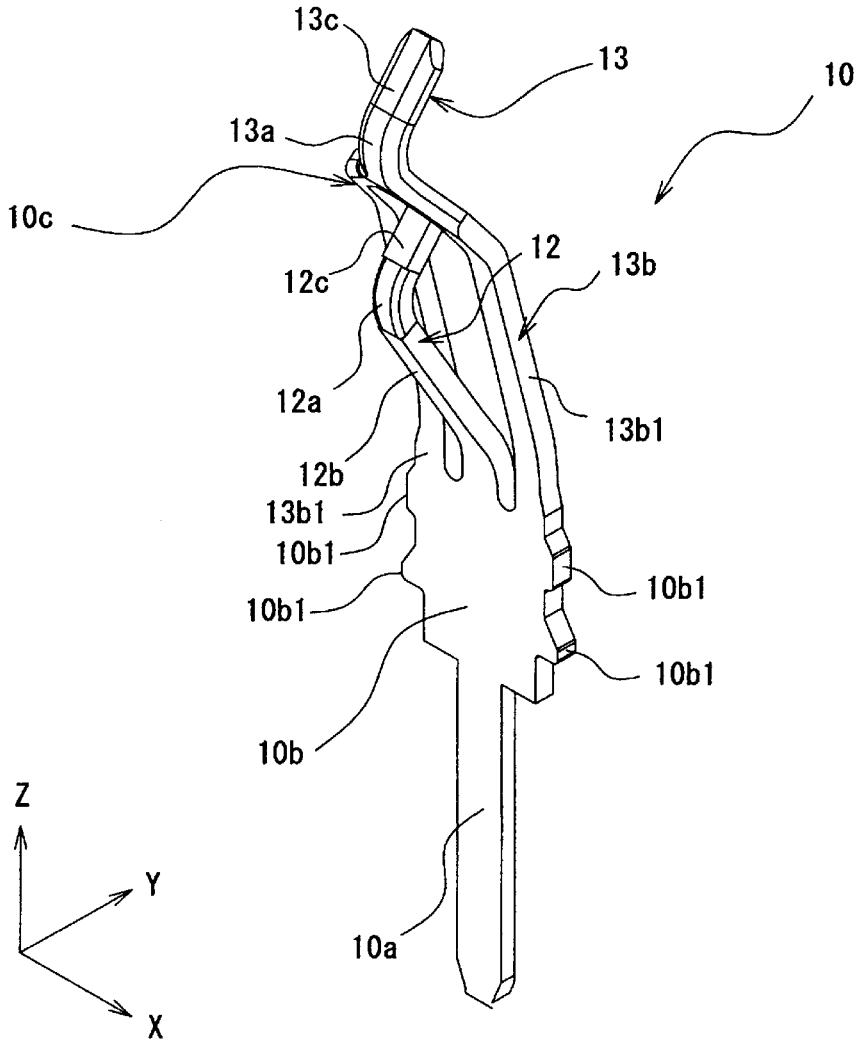
FIG. 13 is an external perspective view of a socket terminal illustrated in FIG. 6.
Figure 14A:
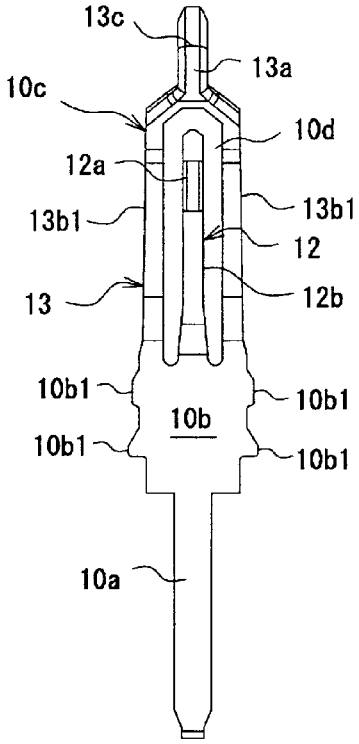
FIG. 14A is a front view of the socket terminal illustrated in FIG. 13.
Figure 14B:
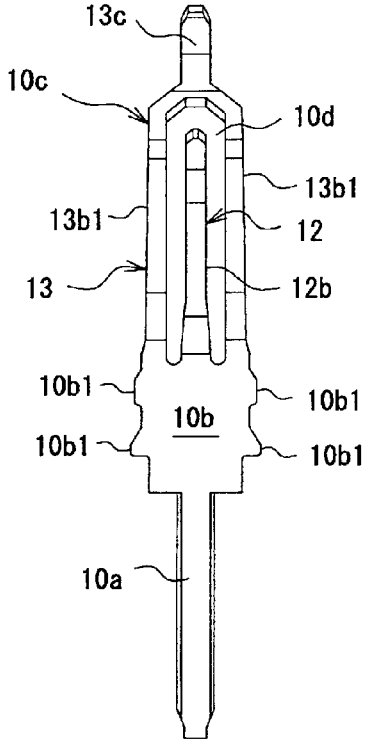
FIG. 14B is a back view of the same.
Figure 14C:
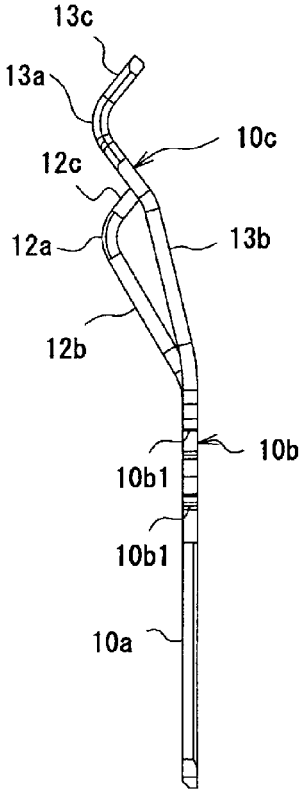
FIG. 14C is a right side view of the same.
Figure 14D:
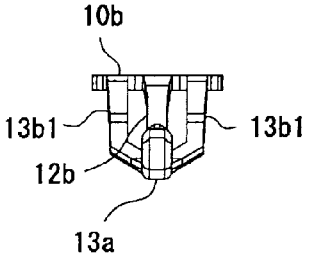
FIG. 14D is a plan view of the same.
Figure 14E:
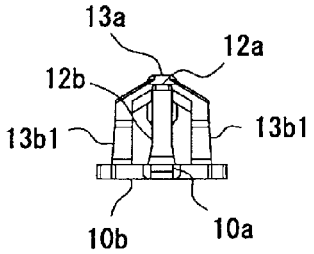
FIG. 14E is a bottom view of the same.
Figure 15:
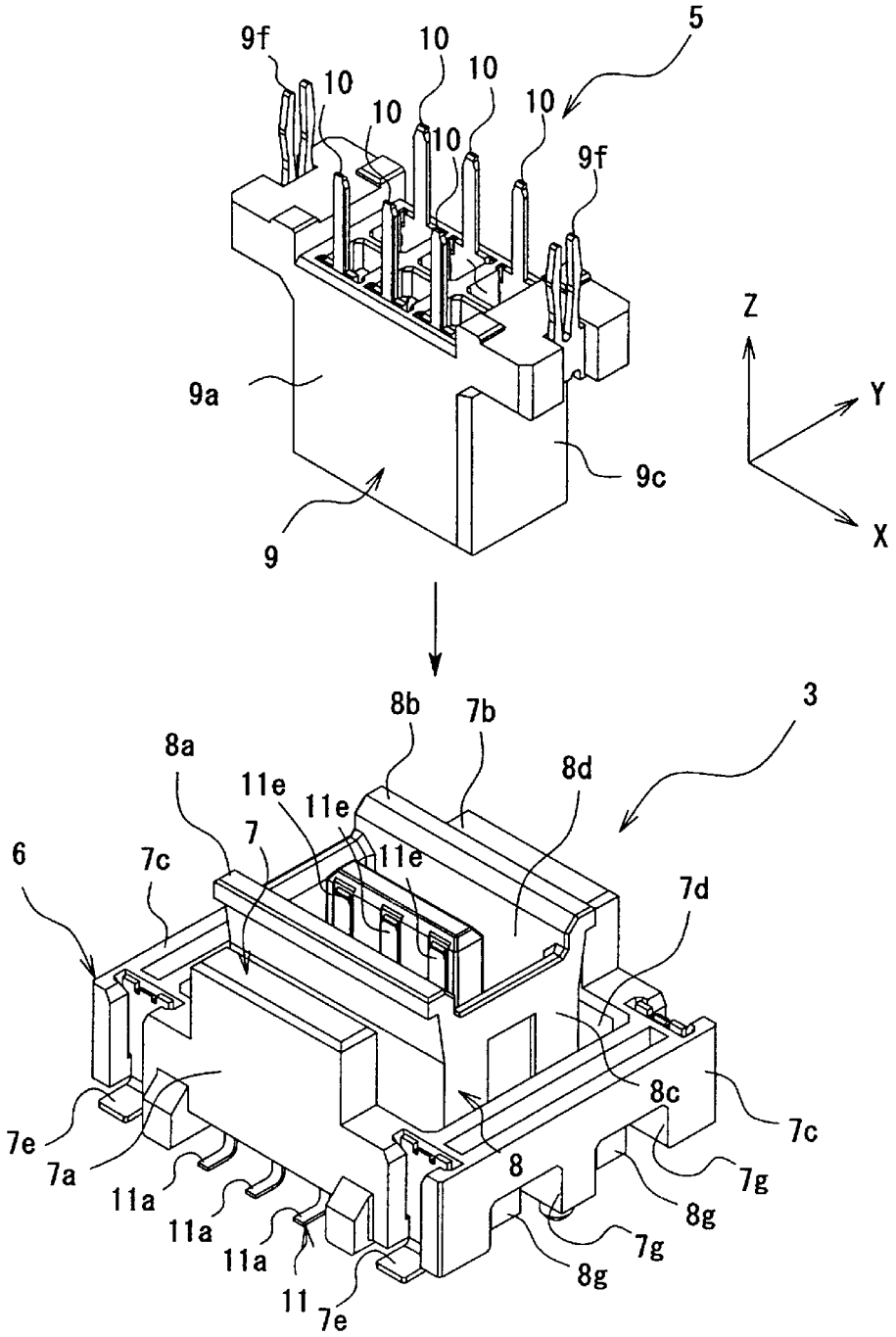
FIG. 15 is an external perspective view of the plug connector of FIG. 1 and the socket connector of FIG. 6 before engagement.

As illustrated in FIG. 11, the movable part 11*c* has a first extending portion 11*c*1 extending upward from the upper end of the fixed portion 11*b*, a first bent portion 11*c*2 extending from the upper end of the first extending portion 11*c*1 and folded back in a substantially inverted U-shape, a second extending portion 11c3 extending downward from the first bent portion 11c2, a second bent portion 11c4 extending from the lower end of the second extending portion 11c3, a third extending portion 11c5 extending from the second bent portion 11c4 along the front-back direction Y, and a third bent portion 11c6 extending from the third extending portion 11c5 and bent upward.

The first extending portion 11c1 is formed in the shape of a narrow strip extending from the upper end of the fixed portion 11b. The first extending portion 11c1 extending upward from the fixed portion 11b in the height direction Z is inclined toward the plug contact portion 11e in the front-back direction Y. Accordingly, in the plug terminal 11 secured to the front portion 7a of the fixed housing 7 (see FIG. 18), a movement gap 7f is created between the first extending portion 11c1 and the front portion 7a. Also, in the plug terminal 11 secured to the back portion 7b of the fixed housing 7, a movement gap 7f is created between the first extending portion 11c1 and the back portion 7b. The first extending portion 11c1 can be elastically deformed inside the movement gap 7f, along the front-back direction Y and the height direction Z.

The first bent portion 11c2 extends from the upper end of the first extending portion 11c1 and is folded back in a substantially inverted U-shape in the sheet surface direction. The first bent portion 11c2 has a greater sheet width than the first extending portion 11c1 for greater rigidity.

The second extending portion 11c3 extends downward, in the height direction Z, from an end of the first bent portion 11c2 opposite the first extending portion 11c1. The second extending portion 11c3 can be elastically displaced along the front-back direction Y and the height direction Z.

The second bent portion 11c4 extends from the lower end of the second extending portion 11c3 to connect the second extending portion 11c3 to the third extending portion 11c5. The second bent portion 11c4 is bent at a substantially right angle in the sheet surface direction.

The third extending portion 11c5 is in the shape of a narrow strip extending from the second bent portion 11c4 along the front-back direction Y. The third extending portion 11c5 can be elastically displaced along the height direction Z and the front-back direction Y. When, for example, the bent portion 11c2, 11c4, or 11c6 is elastically deformed in the extending or bending direction, the third extending portion 11c5 is displaced higher on the side of the third bent portion 11c6 than on the side of the second bent portion 11c4 in the height direction Z and inclined, whereby the plug contact portion 11e (described below) can be elastically displaced upward in the height direction Z (see FIG. 22). Conversely, when the third extending portion 11c5 is displaced lower on the side of the third bent portion 11c6 than on the side of the second bent portion 11c4 in the height direction Z and inclined, the plug contact portion 11e can be elastically displaced downward in the height direction Z (see FIG. 20).

The third bent portion 11c6 extends from the third extending portion 11c5 to connect the third extending portion 11c5 to the base end portion 11d. The third bent portion 11c6 is bent at a substantially right angle in the sheet surface direction.

The base end portion 11d extends from the movable part 11c along the height direction Z. The base end portion 11d has a plurality of press-fit protrusions 11d1 at both ends thereof in the width direction X. The press-fit protrusions 11d1 are press-fitted into the terminal grooves 8f2 in the movable housing 8 (see FIG. 18) and engaged in the inner walls (not shown) of the terminal grooves 8f2, whereby the plug terminals 11 are secured to the movable housing 8.

The plug contact portion 11e is provided as a plate-like piece extending upward from the base end portion 11d along the engagement wall 8f. One surface of the plug contact portion 11e is a contact surface 11e1 exposed to the engagement gap, with the plug terminal 11 secured to the fixed housing 7. The contact surface 11e1 is brought into electrical contact with the corresponding socket terminal 10.

(Socket Connector)

Figure 6:
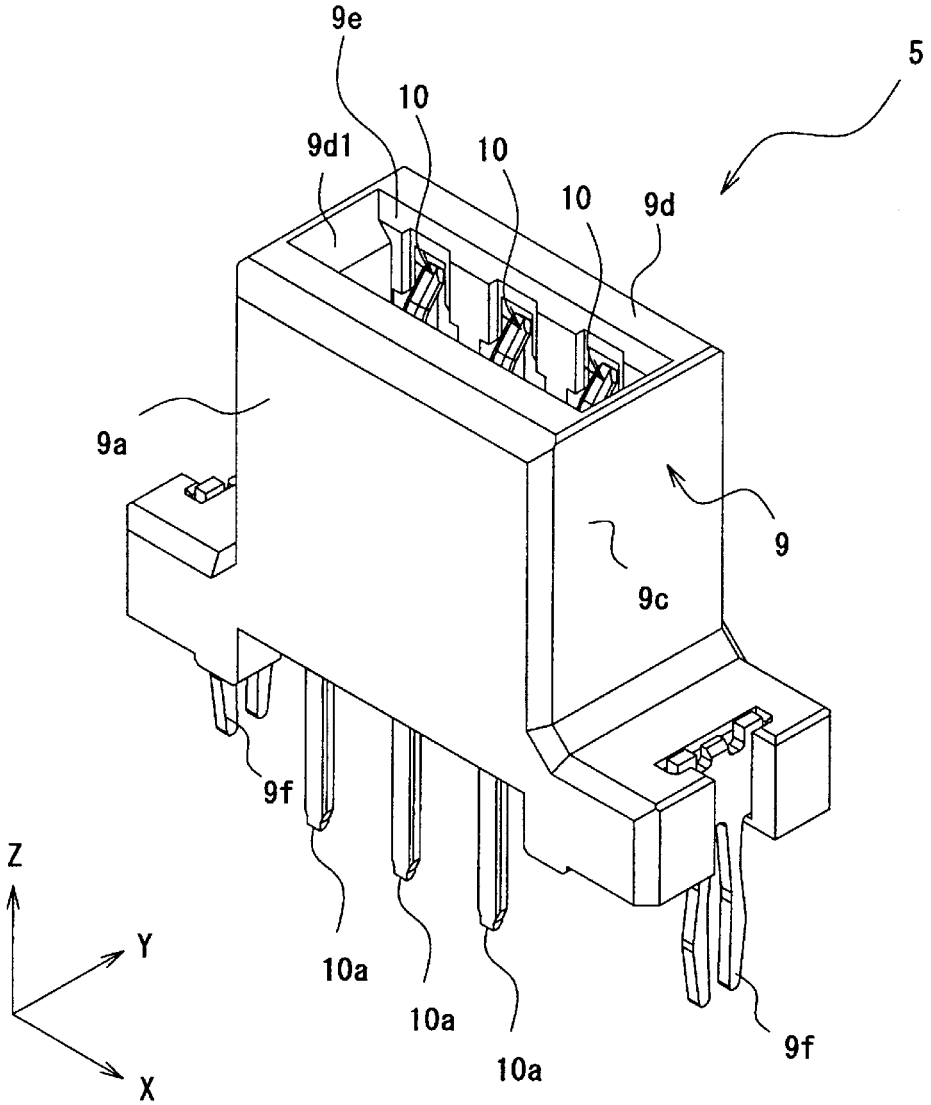
FIG. 6 is an external perspective view of a socket connector according to the first embodiment.
Figure 7:
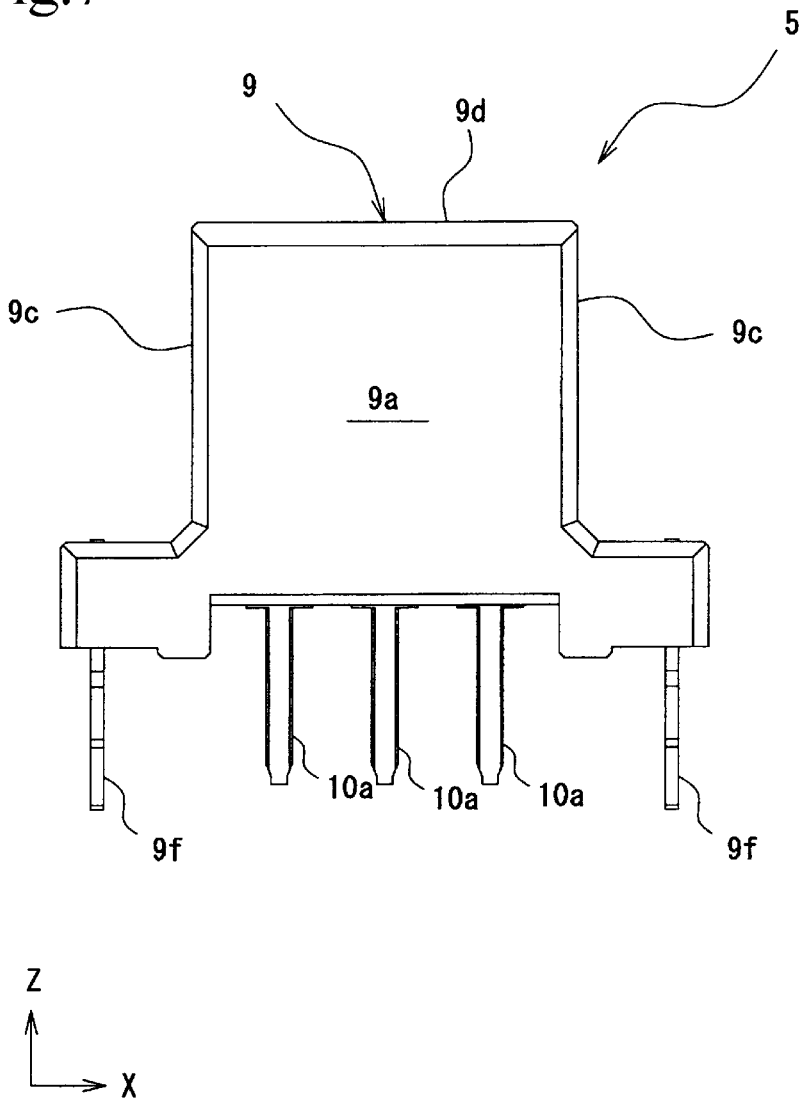
FIG. 7 is a front view of the socket connector illustrated in FIG. 6.
Figure 8:
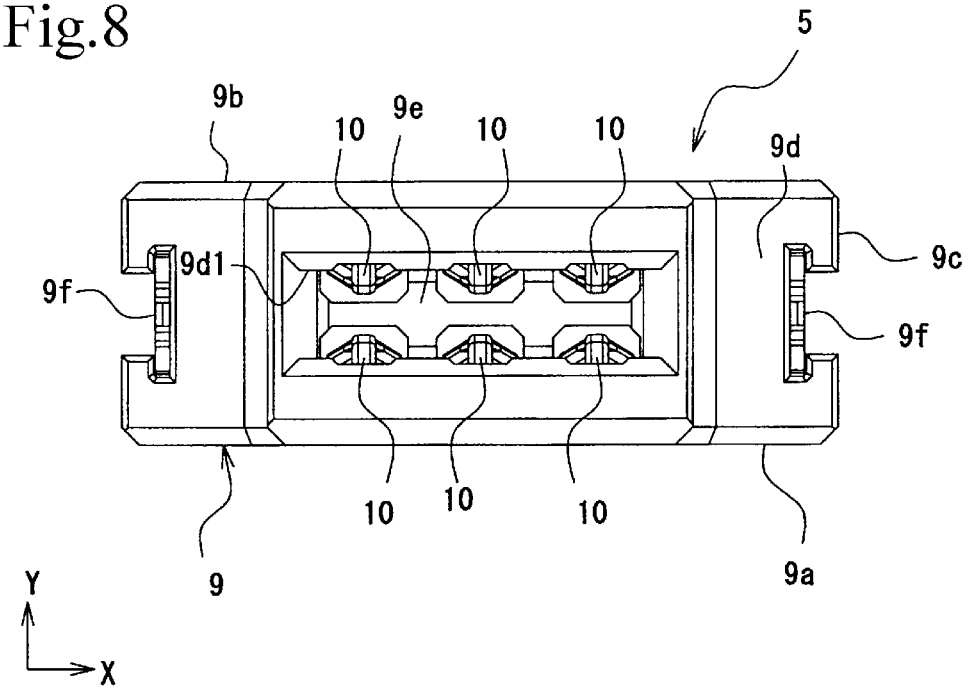
FIG. 8 is a plan view of the socket connector illustrated in FIG. 6.
Figure 9:
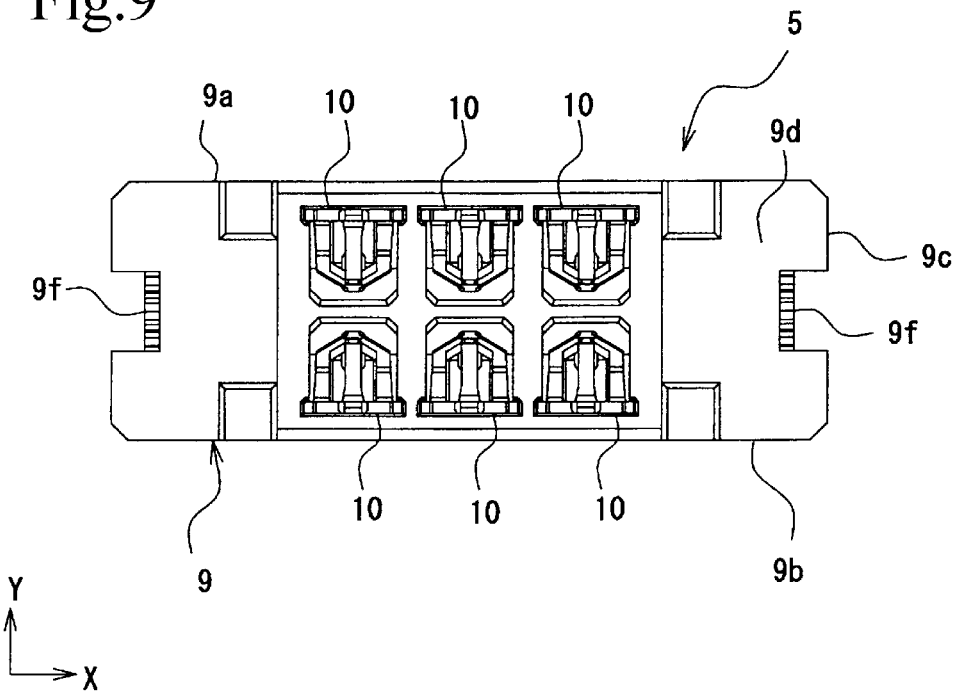
FIG. 9 is a bottom view of the socket connector illustrated in FIG. 6.
Figure 10:
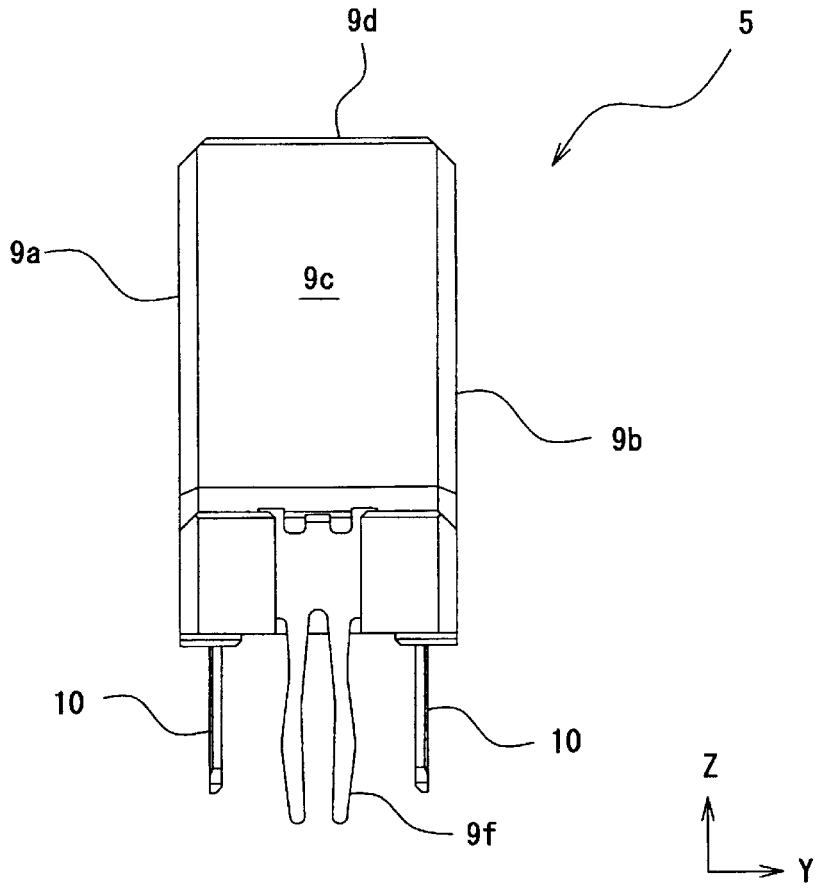
FIG. 10 is a right side view of the socket connector illustrated in FIG. 6.

As illustrated in FIG. 6, the socket connector 5 includes the socket housing 9 and the socket terminals 10 each serving as a "second terminal". The socket connector 5 is a dual in-line package (DIP) connector. The socket terminals 10 are secured to the second substrate 4 by inserting pin-like substrate connection portions 10a of the socket terminals 10 into respective through holes 4a (see FIG. 18) in the second substrate 4 and soldering them.

(Socket Housing)

The socket housing 9 is a molded component of insulating resin. As illustrated in FIGS. 6 to 10, the socket housing 9 is in the shape of a hollow box which is open in a top portion 9d. The socket housing 9 has a front portion 9a, a back portion 9b, and side portions 9c. The upper parts (i.e., lower parts in FIGS. 6 to 10) of the side portions 9c are provided with fixtures 9f to be soldered to the second substrate 4.

The socket housing 9 has an engagement chamber 9e surrounded by the front portion 9a, the back portion 9b, and the side portions 9c. The socket housing 9 also has the receiving port 9d1 opening in the top portion 9d and communicating with the engagement chamber 9e. The receiving port 9d1 receives the engaging part 3A formed by the engagement wall 8f of the plug housing 6 and the plug contact portions 11e of the plug terminals 11. Thus, the socket connector 5 and the plug connector 3 are brought into engagement.

Inner walls 9g (see FIG. 18) of the front portion 9a and back portion 9b facing the engagement chamber 9e have a plurality of terminal accommodating holes 9g1 for accommodating the socket terminals 10. The terminal accommodating holes 9g1 are arranged in parallel, at regular intervals along the width direction X.

(Socket Terminal)

The socket terminals 10 are stamped out of a conductive metal sheet. As illustrated in FIG. 13 and FIGS. 14A to 14E, the socket terminals 10 each include the substrate connection portion 10a, a base end portion 10b, and a socket contact portion 10c serving as a "second contact portion". The socket terminals 10 form pairs of terminals opposite each other with the engagement chamber 9e therebetween (see FIG. 8).

The substrate connection portion 10a of each socket terminal 10 is a pin-like portion extending along the height direction Z. The substrate connection portions 10a are inserted into the through holes 4a (see FIG. 18) in the second substrate 4 and soldered, whereby the socket terminals 10 are brought into electrical contact with the second substrate 4.

The base end portion 10b is in the shape of a flat plate extending from the lower end of the substrate connection portion 10a (i.e., the upper end of the substrate connection portion 10a in FIGS. 6 to 10) and having planar surfaces along the X-Z plane. The base end portion 10b has, at both ends thereof in the width direction X, a plurality of press-fit protrusions 10b1 protruding along the width direction X. The base end portions 10b are press-fitted into the terminal accommodating holes 9g1 (see FIG. 18) in the inner walls 9g of the socket housing 9, and the press-fit protrusions 10*b*1 are engaged in the inner walls (not shown) of the terminal accommodating holes 9*g*1, whereby the socket terminals 10 are secured to the socket housing 9.

The socket contact portion 10*c* has a rear terminal 12 and a front terminal 13.

As illustrated in FIG. 13 and FIGS. 14A to 14E, the rear terminal 12 has a rear contact point 12*a* to be in electrical contact with the corresponding plug terminal 11, and a rear spring portion 12*b* elastically supporting the rear contact point 12*a*.

The rear spring portion 12*b* is in the shape of a narrow strip connected to the lower end of the base end portion 10*b* (i.e., the upper end of the base end portion 10*b* in FIGS. 6 to 10, 13, and 14A to 14E), specifically to substantially the center of the base end portion 10*b* in the width direction X. The rear spring portion 12*b* extends downward (i.e., upward in FIGS. 6 to 10, 13, and 14A to 14E) while being inclined toward the contact with the corresponding plug terminal 11 of the plug connector 3 in the engaged state. The rear spring portion 12*b* is bent, on the leading end side, in the sheet thickness direction to bulge toward the contact with the plug terminal 11, and the bent portion forms the rear contact point 12*a*, which is to be in electrical contact with the plug terminal 11. The rear spring portion 12*b* has a greater sheet width on the base end side than on the leading end side. This enhances the rigidity of the rear spring portion 12*b* on the base end side, and allows distribution of stress generated when the rear contact point 12*a* is pressed by the contact surface 11*e*1 of the plug terminal 11. It is thus possible to reduce plastic deformation, and make the rear contact point 12*a* more resistant to breakage and damage on the base end side. Since the rear spring portion 12*b* is formed as a tapered spring that is reduced in sheet width toward the leading end side, the rear spring portion 12*b* can be elastically deformed flexibly throughout its length.

The rear terminal 12 has a leading-end inclined portion 12*c* extending from the rear contact point 12*a* toward the leading end and inclined in the direction away from the corresponding plug terminal 11 of the plug connector 3 in the engaged state. When the plug connector 3 and the socket connector 5 are brought into engagement, the contact surface 11*e*1 of each plug terminal 11 causes the corresponding rear contact point 12*a* to be displaced in the direction away from the contact surface 11*e*1 while sliding along the leading-end inclined portion 12*c*.

As illustrated in FIG. 13 and FIGS. 14A to 14E, the front terminal 13 has a front contact point 13*a* to be in electrical contact with the corresponding plug terminal 11, and a front spring portion 13*b* elastically supporting the front contact point 13*a*. The front contact point 13*a* is located at the same position as the rear contact point 12*a* in the width direction X. Therefore, the front contact point 13*a* can wipe foreign material from the plug contact portion 11*e*1 of the plug terminal 11, as described below.

The front spring portion 13*b* bifurcates into two front legs 13*b*1 which are in the shape of a narrow strip. The front legs 13*b*1 extend from the lower end of the base end portion 10*b* (i.e., the upper end of the base end portion 10*b* in FIGS. 6 to 10) on both sides of the rear spring portion 12*b* in the width direction X.

Each of the front legs 13*b*1 extends downward (i.e., upward in FIGS. 6 to 10) from the base end side toward the leading end side while being inclined toward the contact with the corresponding plug terminal 11 of the plug connector 3 in the engaged state. The front legs 13*b*1 extend parallel with the rear spring portion 12*b* on both sides of the rear spring portion 12*b*. The two front legs 13*b*1 are bent on the leading end side below the leading-end inclined portion 12*c* of the rear terminal 12 in the height direction Z (i.e., above the leading-end inclined portion 12*c* in FIGS. 6 to 10, 13, and 14A to 14E) to approach each other and are combined together. Then, the front spring portion 13*b* is bent on the leading end side to bulge toward the corresponding contact surface 11*e*1 of the plug terminal 11 of the plug connector 3 in the engaged state. The bent portion forms the front contact point 13*a*, which is to be in electrical contact with the plug terminal 11. The front terminal 13 has a leading-end inclined portion 13*c* extending from the front contact point 13*a* toward the leading end. When the plug connector 3 and the socket connector 5 are brought into engagement, the contact surface 11*e*1 of each plug terminal 11 causes the corresponding front contact point 13*a* to be displaced in the direction away from the contact surface 11*e*1 while sliding along the leading-end inclined portion 13*c*.

A space 10*d* is created between the rear spring portion 12*b* and each of the front legs 13*b*1. The front legs 13*b*1 and the rear spring portion 12*b* elastically deform independent of each other. The front terminal 13 is not in contact with the rear terminal 12 in either of the engaged state and the non-engaged state of the plug connector 3 and the socket connector 5. The rear spring portion 12*b* is positioned in the space between the two front legs 13*b*1, and hence its deformation in the width direction X is restricted by the front legs 13*b*1. Thus, the rear terminal 12 can be prevented from being accidentally deformed excessively in the width direction X. Also, since the front spring portion 13*b* has two front legs 13*b*1 along the width direction X, the front spring portion 13*b* is not easily deformed in the width direction X.

Although the contact pressure of the front terminal 13 and the contact pressure of the rear terminal 12 can be adjusted as appropriate, it is preferable that the contact pressure of the front terminal 13 be slightly lower than the contact pressure of the rear terminal 12. This allows the plug connector 3 and the socket connector 5 to be brought into engagement without much force. The front contact point 13*a* of the front terminal 13 protrudes more toward the plug terminal 11 than the rear contact point 12*a* of the rear terminal 12 does, so that the front contact point 13*a* can be reliably brought into contact with the contact surface 11*e*1 of the plug terminal 11. This ensures more effective removal of foreign material (described below).

The width of the front contact point 13*a* and the width of the rear contact point 12*a* can be set in accordance with the application. For example, the width of the front contact point 13*a* and the width of the rear contact point 12*a* may be substantially the same. When the socket connector 5 is brought into engagement with the plug connector 3, the rear contact point 12*a* follows the path of the front contact point 13*a*. Therefore, if the rear contact point 12*a* and the front contact point 13*a* have the same width, the rear contact point 12*a* can follow the path from which foreign material has been thoroughly wiped off by passage of the front contact point 13*a*. Also, if the rear contact point 12*a* and the front contact point 13*a* have the same width, it is possible to reduce displacement between the position at which the front contact point 13*a* comes into contact with the plug terminal 11 and the position at which the rear contact point 12*a* comes into contact with the plug terminal 11.

Alternatively, the width of the front contact point 13*a* may be greater than the width of the rear contact point 12*a*. With the front contact point 13*a* of a greater width, foreign material is wiped off in a wider area. In this case, even if the front terminal 13 and the rear terminal 12 are positionally displaced relative to each other in the width direction X, it is possible to ensure effective removal of foreign material from the contact area of the rear contact point 12*a*.

(Engaging Operation)

The electric connector 1 including the socket connector 5 and the plug connector 3 configured as described above can electrically connect the first substrate 2 and the second substrate 4. As illustrated in FIGS. 15 to 19, when the socket connector 5 connected to the second substrate 4 is brought into engagement with the plug connector 3 connected to the first substrate 2 from above the plug connector 3, the socket connector 5 is lowered to insert the engaging part 3A of the plug connector 3 into the receiving port 9*d*1 of the socket connector 5.

Figure 18:
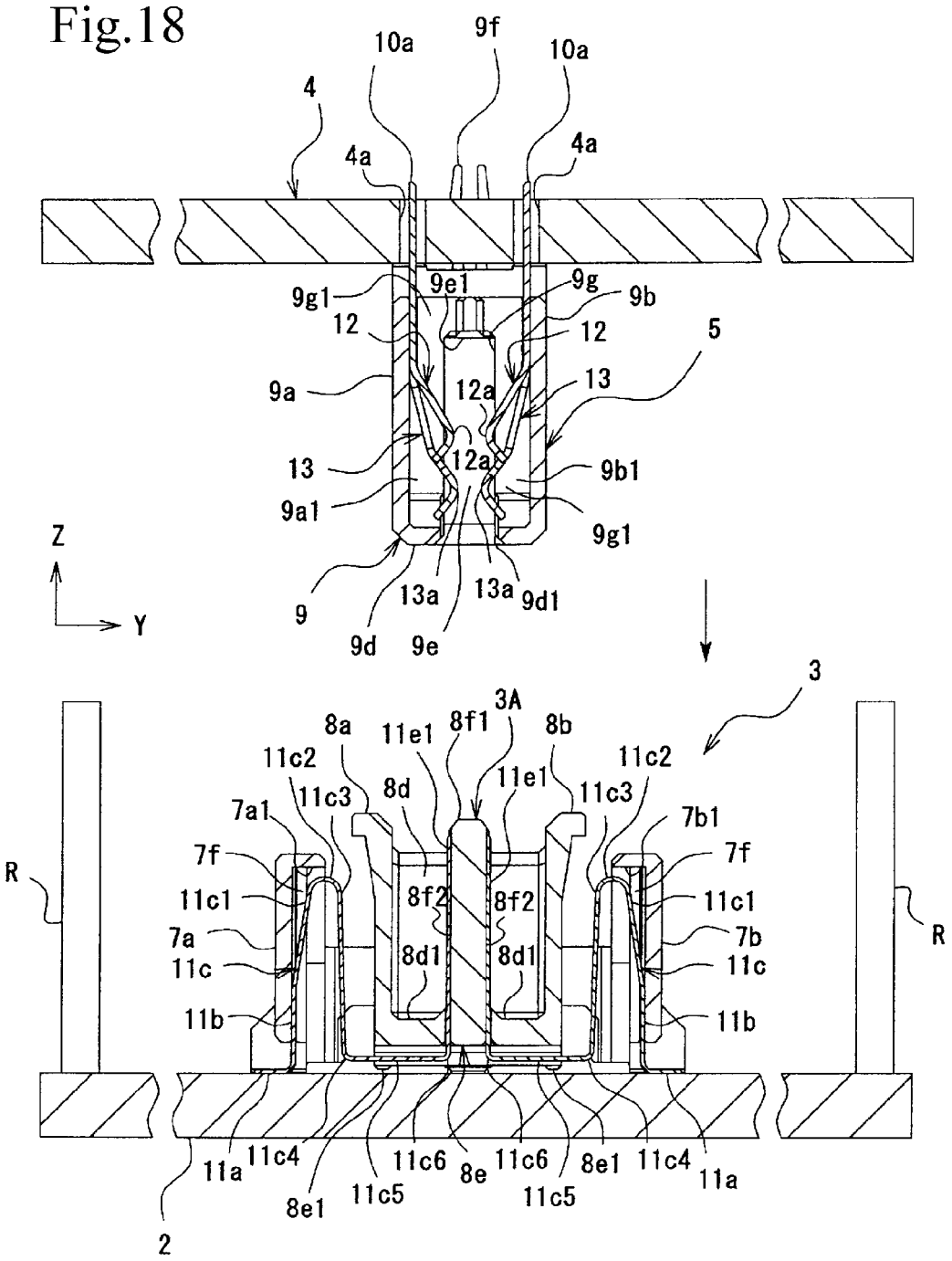
FIG. 18 is a cross-sectional view of the plug connector of FIG. 1 and the socket connector of FIG. 6 before engagement.
Figure 19:
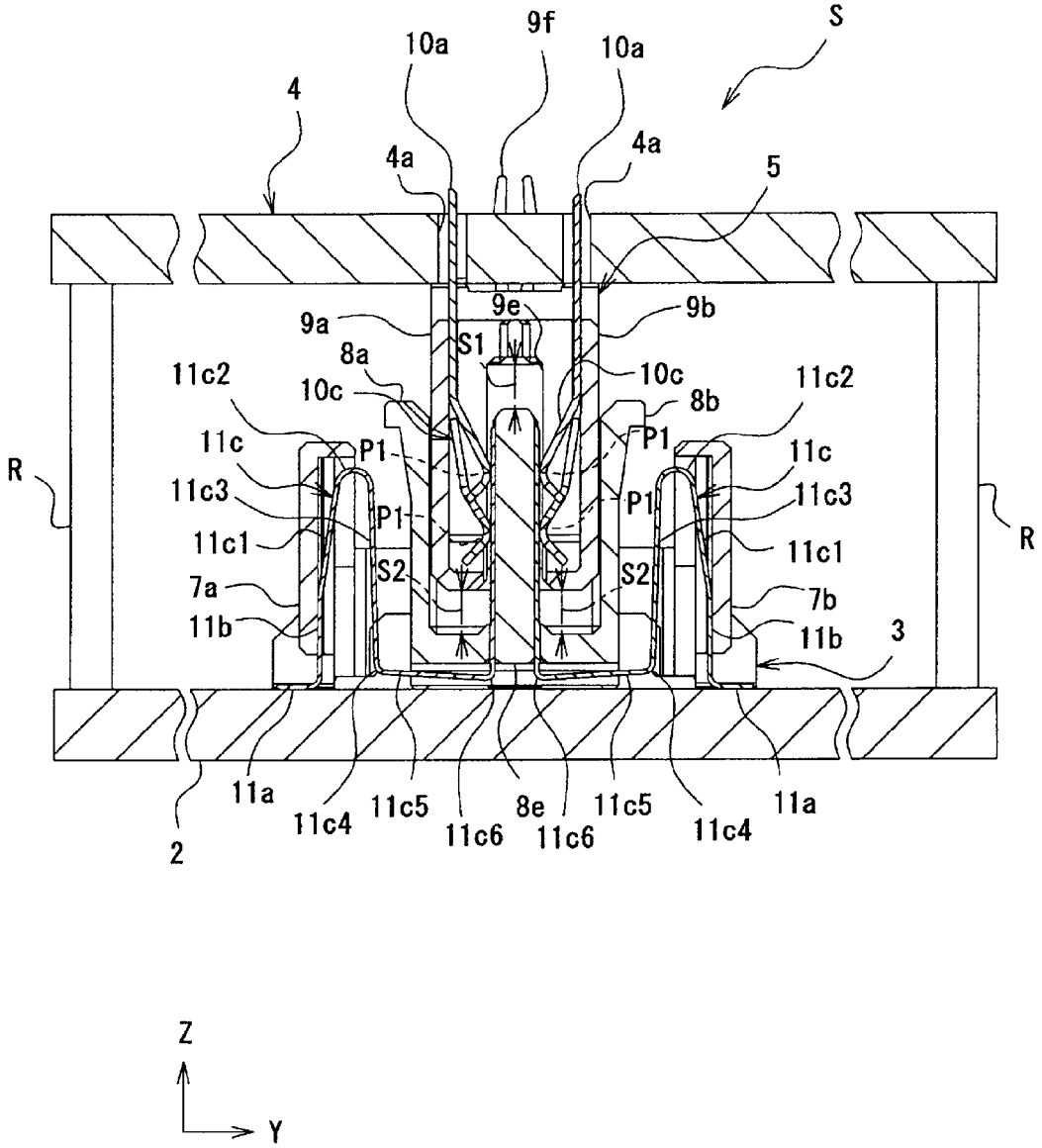
FIG. 19 is a cross-sectional view of the plug connector of FIG. 1 and the socket connector of FIG. 6 in an initial engaged state.

The socket terminals 10, each having the front contact point 13*a* and the rear contact point 12*a*, face each other, with the engagement chamber 9*e* therebetween (see FIG. 18). The distance between opposite front contact points 13*a* and the distance between opposite rear contact points 12*a*, in the front-back direction Y, are shorter than the length of the engaging part 3A in the front-back direction Y. Therefore, when the engaging part 3A is inserted into the space between the front contact points 13*a* and between the rear contact points 12*a*, the space between the front contact points 13*a* and between the rear contact points 12*a* is widened by an end portion 8*f*1 of the engagement wall 8*f*. Specifically, first, the socket terminals 10 are brought into contact with the plug terminals 11 on the leading end side, and the leading-end inclined portions 13*c* of the front terminals 13 of the socket connector 5 hit the end portion 8*f*1 of the engagement wall 8*f* of the plug connector 3, thereby guiding the engagement wall 8*f* toward the inside of the engagement chamber 9*e*. Then, the leading-end inclined portions 12*c* of the rear terminals 12 also hit the end portion 8*f*1 of the engagement wall 8*f*, thereby guiding the engagement wall 8*f* toward the inside of the engagement chamber 9*e*.

In the present embodiment, the load required to elastically deform the movable parts 11*c* is set lower than the load required for relative positional displacement of the contact portions 10*c* and 11*e*, and hence the contact portions 10*c* and 11*e* do not easily slide with respect to each other. Therefore, even when the engaging operation continues, the contact portions 10*c* and 11*e* do not significantly slide with respect to each other. A load is applied through the contact portions 10*c* and 11*e* to the movable parts 11*c*, which are elastically deformed in the mating direction of the socket connector 5. When the movable parts 11*c* are elastically deformed until they can be deformed no further, or when the abutting portions 8*e*1 of the movable housing 8 are brought into contact with the first substrate 2, the elastic deformation of the movable parts 11*c* is stopped. Then, when the engaging operation is further continued and the engaging part 3A is inserted into the engagement chamber 9*e* of the socket housing 9, the front contact points 13*a* and the rear contact points 12*a* of the socket terminals 10 slide with respect to the plug terminals 11. When the engaging operation is further continued, the plug terminals 11 and the socket terminals 10 can be eventually brought into electrical contact with each other at normal contact positions P2 (see FIG. 21) described below.

In this engaged state, the front contact points 13*a* and the rear contact points 12*a* of the opposite socket terminals 10 are in pressure contact with the engaging part 3A with the same load. Thus, the socket contact portions 10*c* of the socket terminals 10 can be in electrical contact with the plug contact portions 11*e*, with the engaging part 3A of the plug connector 3 sandwiched between the socket contact portions 10*c*.

(Removal of Foreign Material)

Figure 21:
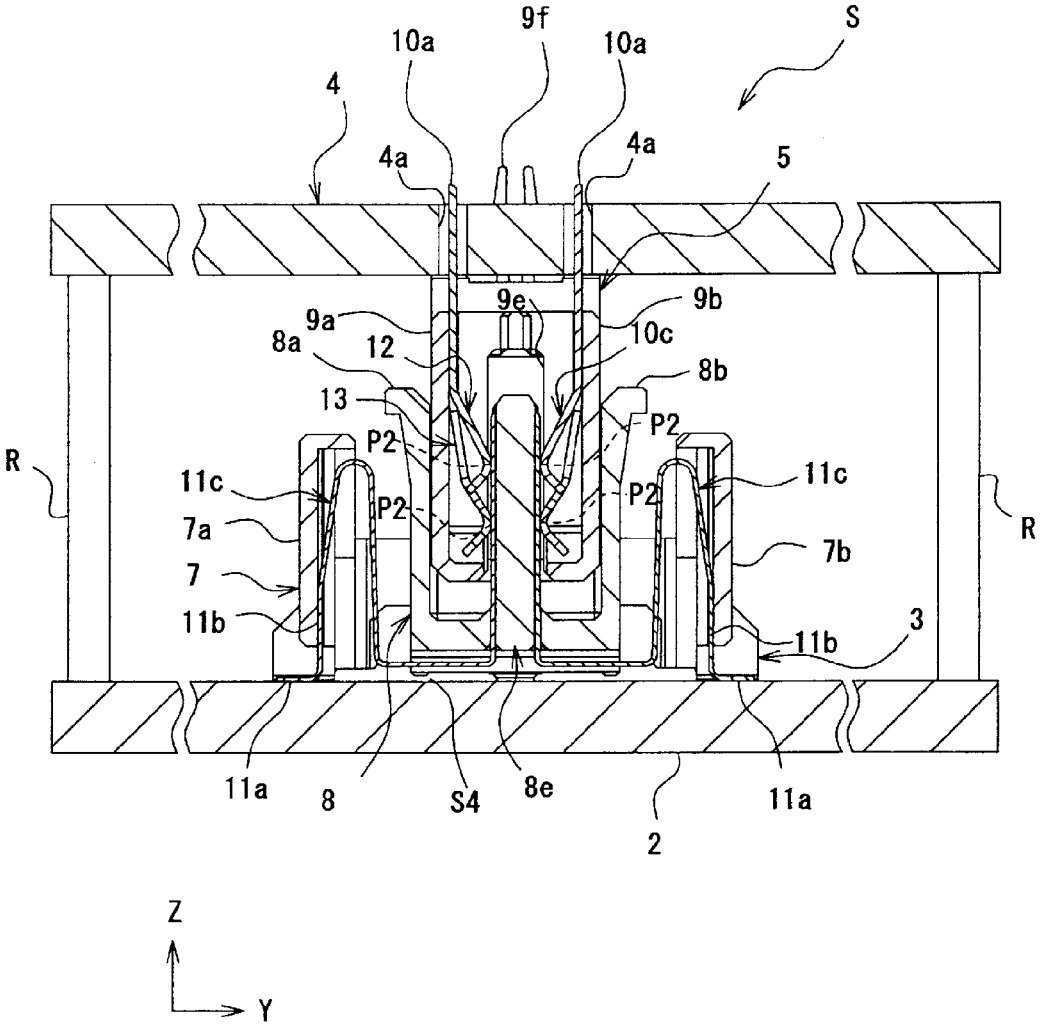
FIG. 21 is a cross-sectional view of the plug connector of FIG. 1 and the socket connector of FIG. 6 in an engaged state.
Figure 22:
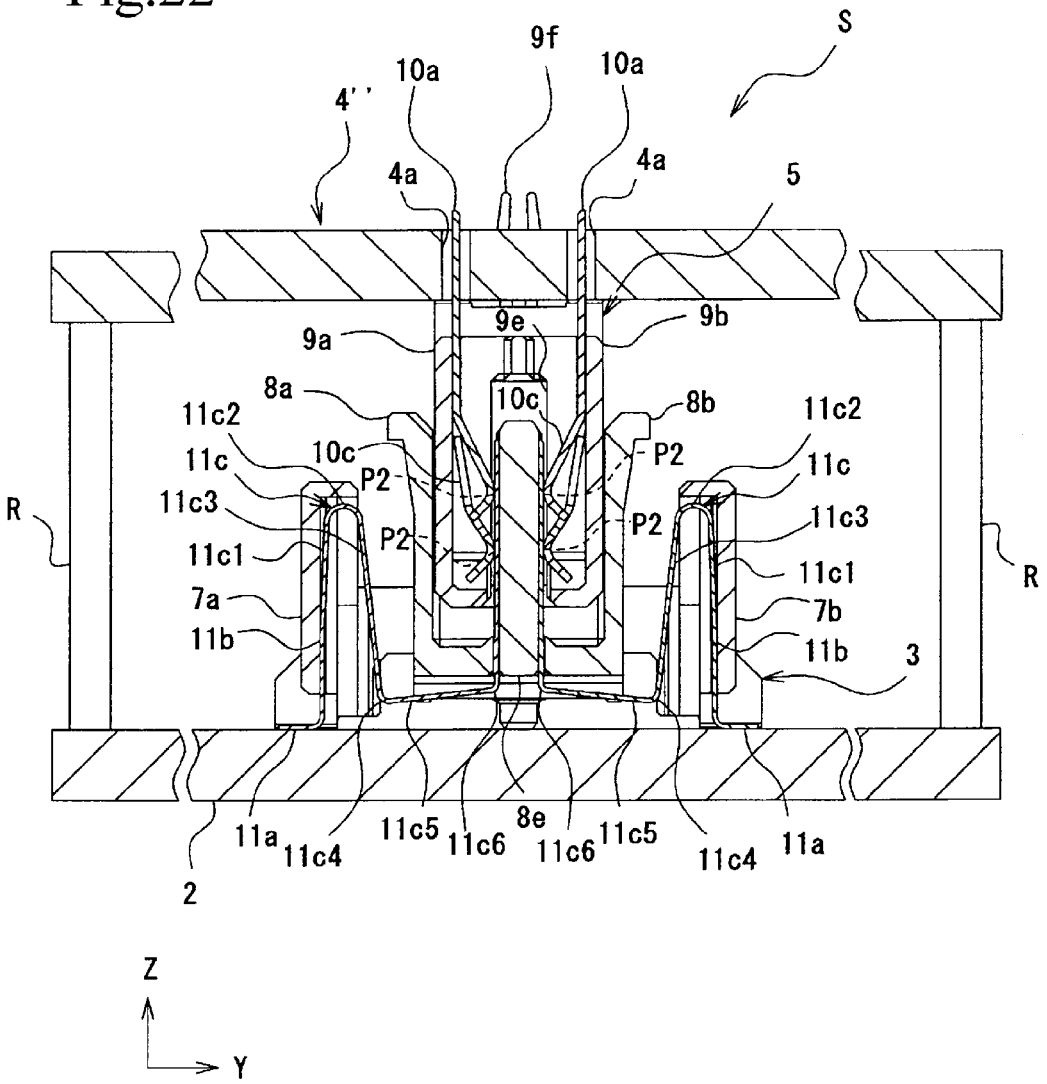
FIG. 22 is a cross-sectional view of the plug connector of FIG. 1 and the socket connector of FIG. 6 in a vibration top dead center state.

As described above, the front contact point 13*a* and the rear contact point 12*a* are located in the same position in the width direction X. Therefore, when the socket terminals 10 and the plug terminals 11 slide with respect to each other, each rear contact point 12*a* is brought into contact with the corresponding contact surface 11*e*1 of the plug terminal 11 along the path of the leading-end inclined portion 13*c* and the front contact point 13*a*. Therefore, even if foreign material, such as dirt or dust, is on the plug terminal 11, the foreign material is removed or held by the front contact point 13*a*, and is removed from the path of the front terminal 13. Thus, the rear contact point 12*a* following the path from which the foreign material has been removed can be brought into reliable electrical contact with the plug terminal 11. Then, as illustrated in FIG. 21, both the front contact points 13*a* and the rear contact points 12*a* are eventually brought into contact with the contact surfaces 11*e*1 of the plug terminals 11. Thus, in the engaged state of the plug connector 3 and the socket connector 5, the reliability of the electrical contact between the plug terminals 11 and the socket terminals 10 can be improved.

(Movement in X and Y Directions)

The movement of the movable housing 8 with respect to the fixed housing 7 in the front-back direction Y and the width direction X will be described. The movement gap 7*f* (see FIG. 18) is provided between the first extending portion 11*c*1 of the movable part 11*c* and the front portion 7*a* of the fixed housing 7, and between the first extending portion 11*c*1 of the movable part 11*c* and back portion 7*b* of the fixed housing 7. Therefore, inside the movement gap 7*f*, for example, the first extending portion 11*c*1 can be displaced toward or away from the front portion 7*a* or back portion 7*b* along the front-back direction Y. Also, for example, the second extending portion 11*c*3 can be elastically deformed toward or away from the front portion 7*a* or back portion 7*b* along the front-back direction Y. When this causes vibration to the electric connector 1 in the front-back direction Y, the movable part 11*c* is elastically deformed in the front-back direction Y to allow the movable housing 8 to be elastically displaced in the front-back direction Y with respect to the fixed housing 7, and thus the vibration can be absorbed.

The movable part 11*c* is in the shape of a narrow strip and is formed by bending a conductive metal sheet. The movable part 11*c* can thus be elastically deformed such that one end and the other end thereof are positioned differently in the width direction X. The movable part 11*c* connects at one end thereof to the fixed portion 11*b* to be secured to the fixed housing 7, and connects at the other end thereof to the base end portion 11*d* to be secured to the movable housing 8. Therefore, when a vibration in the width direction X is applied to the electric connector 1, the movable part 11*c* is elastically deformed in the width direction X to allow the movable housing 8 to be displaced relative to the fixed housing 7 in the width direction X, and thus the vibration can be absorbed.

As described above, in the plug housing 6, the movement space 7*d* (see FIGS. 5 and 16) is provided between the front portion 8*a* of the movable housing 8 and the front portion 7*a* of the fixed housing 7, and between the back portion 8*b* of the movable housing 8 and the back portion 7*b* of the fixed housing 7. Therefore, inside the movement space 7*d*, the movable housing 8 can be displaced in the front-back direction Y relative to the fixed housing 7. In the plug housing 6, the movement space 7*d* is also provided between each side portion 8*c* of the movable housing 8 and the corresponding side portion 7*c* of the fixed housing 7. Therefore, inside the movement space 7*d*, the movable housing 8 can also be displaced in the width direction X relative to the fixed housing 7.

If a vibration in the front-back direction Y or width direction X is applied to the electric connector 1 when the plug connector 3 and the socket connector 5 are in an engaged state, the movable parts 11*c* of the plug terminals 11 are elastically deformed to allow the movable housing 8 of the plug connector 3 to be displaced relative to the fixed housing 7. It is thus possible to absorb the vibration and maintain the electrical contact between the plug terminals 11 and the socket terminals 10.

(Movement in Z Direction)

The movement of the movable housing 8 with respect to the fixed housing 7 in the height direction Z will now be described. In the connector of the related art, in response to vibration in the height direction Z, the plug terminals and the socket terminals slide with respect to each other in the height direction Z to maintain the electrical contact therebetween. However, this method may cause wear of the electrical contact portions of the plug terminals and the socket terminals, and may lower the connection reliability. On the other hand, in the electric connector 1 of the present embodiment, a vibration in the height direction Z can be absorbed by the movable parts 11*c* of the plug terminals 11. It is thus possible to reduce wear between the plug terminals 11 and the socket terminals 10, prevent easy peeling of plating for higher electrical conductivity, and thus improve connection reliability of the electric connector 1.

When the frequency of vibration reaches the natural frequency of the substrates 2 and 4, the resonance of the substrates 2 and 4 may cause the connectors 3 and 5 to vibrate significantly. In this case, in the method of the related art in which contact points slide with respect to each other, the distance available for the sliding is too short to absorb the significant vibration, and hence the electrical contact between the contact points may become unstable. However, in the electric connector 1 of the present embodiment, even if such resonance occurs, the movable parts 11*c* are elastically deformed to allow the plug terminals 11 to sufficiently follow the displacement of the socket terminals 10, whereby the electrical contact between the contact portions 10*c* and 11*e* can be maintained without sliding of the contact portions 10*c* and 11*e*. The electric connector 1 with high connection reliability can thus be provided.

The movement of the electric connector 1 in the height direction Z will now be specifically described. The load required for elastic deformation of the movable parts 11*c* in the mating and unmating directions is set smaller than the load required for relative positional displacement of the socket terminals 10 and the plug terminals 11 from the normal contact positions P2 in the mating and unmating directions. Therefore, when a vibration in the height direction Z is applied to the electric connector 1, the movable parts 11*c* are first elastically deformed in the mating and unmating directions before the socket contact portions 10*c* and the plug contact portions 11*e* slide with respect to each other. That is, the movable parts 11*c* are elastically deformed inside the plug housing 6 toward the first substrate 2, or the movable parts 11*c* are deformed in the bending direction until they can be deformed no further, whereby the movable parts 11*c* are elastically deformed in the mating and unmating directions. During this elastic deformation, the socket terminals 10 and the plug terminals 11 are not relatively positionally displaced from the normal contact positions P2, and hence the electrical contact between the socket terminals 10 and the plug terminals 11 can be maintained. Thus, the plug terminals 11 are elastically displaced in accordance with the displacement of the socket terminals 10, and the electrical contact between them can be maintained.

A more detailed description will be given. When a vibration in the height direction Z is applied to the electric connector 1, for example, the second bent portions 11*c*4 of the movable parts 11*c* are elastically deformed in the bending direction, whereas the third bent portions 11*c*6 are elastically deformed in the extending direction. At the same time, the first bent portions 11*c*2 are elastically displaced toward the front portion 7*a* or back portion 7*b* in the direction away from the movable housing 8, whereby the plug contact portions 11*e* of the plug terminals 11 can be elastically displaced upward in the height direction Z (see FIG. 22).

Conversely, the third bent portions 11*c*6 may be elastically deformed in the bending direction, whereas the second bent portion 11*c*4 may be elastically deformed in the extending direction. At the same time, the first bent portions 11*c*2 are elastically displaced toward the movable housing 8 in the direction away from the front portion 7*a* or back portion 7*b*, whereby the plug contact portions 11*e* of the plug terminals 11 can be relatively displaced downward in the height direction Z (see FIG. 20). Thus, even when a vibration in the height direction Z is applied, the movable parts 11*c* can be elastically deformed to absorb the vibration.

(Restriction of Movement)

The movable housing 8 can be displaced relative to the fixed housing 7, but the relative displacement in the width direction X and the front-back direction Y is restricted within the movement space 7*d*. The side portions 8*c* of the movable housing 8 each have, at the lower end thereof, a plurality of locking portions 8*g* (see FIG. 4) protruding along the width direction X. The fixed housing 7 has a plurality of recessed portions 7*g* (see FIG. 1) for insertion of the locking portions 8*g* therein. Even when the movable housing 8 is displaced upward in the height direction Z with respect to the fixed housing 7, the locking portions 8*g* are retained by inner edges 7*g*1 (see FIG. 5) of the recessed portions 7*g*, whereby the displacement of the movable housing 8 with respect to the fixed housing 7 is restricted. Thus, the displacement of the movable housing 8 relative to the fixed housing 7 in the width direction X, the front-back direction Y, and the height direction Z can be restricted. Since the plug terminals 11 are secured to both the fixed housing 7 and the movable housing 8, the elastic deformation of the movable parts 11*c* is also restricted. Additionally, since the movable parts 11*c* are contained in the plug housing 6, the elastic deformation of the movable parts 11*c* is also restricted by walls of the plug housing 6.

(Adjustment of Load Required for Positional Displacement of Socket Terminals with Respect to Plug Terminals)

For the front spring portions 13*b* and the rear spring portions 12*b* of the socket terminals 10, the sheet thickness, the sheet width, and the angle of inclination with respect to the engaging direction of the plug connector 3 are adjusted, whereby the load required for relative positional displacement of the front terminal 13 and the rear terminal 12 from the normal contact positions P2 in the mating and unmating directions can be adjusted. That is, by increasing the sheet thickness or sheet width of the front spring portions 13*b* and the rear spring portions 12*b*, or increasing the angle of inclination of the front spring portions 13*b* and the rear spring portions 12*b* with respect to the mating and unmating directions of the plug connector 3, the front spring portions 13*b* and the rear spring portions 12*b* can be more strongly brought into contact with the plug terminals 11, and can be made resistant to deformation in a direction away from the plug terminals 11. The load described above can thus be increased. Conversely, by reducing their sheet thickness or sheet width, or reducing their angle of inclination with respect to the engaging direction of the plug connector 3, the front spring portions 13*b* and the rear spring portions 12*b* can be more lightly brought into contact with the plug terminals 11, and can be made more easily deformable in a direction away from the plug terminals 11. The load described above can thus be reduced.

By increasing the sheet width of the front contact points 13*a* and the rear contact points 12*a*, the area of contact with the contact surfaces 11*e*1 of the plug terminals 11 can be increased, and hence the frictional force can be increased. The load described above can thus be increased.

Conversely, by reducing the sheet width of the contact points 12*a* and 13*a* or softening the rear spring portions 12*b* and the front spring portions 13*b*, the frictional force generated in the contact points 12*a* and 13*a* can be reduced. By reducing the sheet width of the front contact points 13*a* and the rear contact points 12*a*, the area of contact with the contact surfaces 11*e*1 of the plug terminals 11 can be reduced, and hence the frictional force can be reduced. The load described above can thus be reduced.

Each socket terminal 10 is pressed into contact with the corresponding plug terminal 11 at two contact points, the front contact point 13*a* and the rear contact point 12*a*. Since the frictional force is thus generated at the two points, the front contact point 13*a* and the rear contact point 12*a*, the load required for relative positional displacement from the normal contact positions P2 in the mating and unmating directions can be easily made greater than that in the case where each socket terminal 10 is pressed into contact with the corresponding plug terminal 11 at one contact point. Also, each socket terminal 10 has two front legs 13*b*1, and the sum of the lengths of the two front legs 13*b*1 in the sheet width direction is set longer than the length of the corresponding movable part 11*c* in the sheet width direction. Thus, the socket terminals 10 are strongly pressed into contact with the plug terminals 11, and hence the frictional force generated during sliding is increased. Therefore, the load required for relative positional displacement from the normal contact positions P2 in the mating and unmating directions can be made greater than the load required for elastic deformation of the movable parts 11*c* in the mating and unmating directions.

The load required for sliding is distributed between the contact points 12*a* and 13*a* as described above, whereby the contact points 12*a* and 13*a* can be more lightly pressed into contact with the plug terminals 11. Therefore, even when the socket contact portions 10*c* and 11*e* slide with respect to each other during repeated mating and unmating of the connectors 3 and 5, the contact points 12*a* and 13*a* and the contact surfaces 11*e*1 of the plug terminals 11 are not easily worn out or damaged.

(Adjustment of Load Required for Elastic Deformation of Movable Part)

By adjusting the sheet width of the movable parts 11*c* of the plug terminals 11, the load required for elastic deformation of the movable parts 11*c* can be adjusted. Specifically, when the movable parts 11*c* have a smaller sheet width, the movable parts 11*c* are elastically deformed with a smaller load. Conversely, when the movable parts 11*c* have a larger sheet width, the movable parts 11*c* requires a larger load to be elastically deformed. Particularly in the present embodiment, the sheet width of the first bent portions 11*c*2 and the third bent portions 11*c*6 of the movable parts 11*c* is set greater than the sheet width of the extending portions 11*c*1, 11*c*3, and 11*c*5. On the other hand, the sheet width of the second bent portions 11*c*4 is set substantially the same as that of the extending portions 11*c*1, 11*c*3, and 11*c*5, and smaller than that of the other bent portions 11*c*2 and 11*c*6. Therefore, the second bent portions 11*c*4 are more easily elastically deformed and softer than the other bent portions 11*c*2 and 11*c*6. Thus, when a vibration in the height direction Z is applied, the second bent portions 11*c*4 are most easily elastically deformed. By varying the sheet width of each portion of the movable part 11*c* as described above, the load required for elastic deformation can be adjusted.

(Absorption of Vibration by Resonance of Substrates)

A particularly large vibration may be applied to the electric connector 1 by resonance of the substrates 2 and 4. In this case, if the plug terminals 11 and the socket terminals 10 slide with respect to each other to absorb the vibration as in the related art, the plug terminals 11 and the socket terminals 10 are heavily worn out or damaged. Also, as compared to the magnitude of vibration of the substrates 2 and 4 by resonance, the distance over which the contact portions 10*c* and 11*e* can slide with respect to each other is too short to absorb the significant vibration, and the plug terminals 11 and the socket terminals 10 may be spaced apart. However, in the electric connector 1 of the present embodiment, since the movable parts 11*c* are sufficiently elastically deformed in the mating and unmating directions, a vibration in the height direction Z can be absorbed. Thus, the contact portions of the plug terminals 11 and the socket terminals 10 are not easily worn out, and the vibration produced by resonance can be sufficiently absorbed.

The electric connector 1 of the present embodiment has a mechanism for reliably maintaining the electrical contact even when a vibration is produced by resonance. This mechanism will now be described with reference to the schematic diagrams of FIGS. 17A to 17F. In this example, the first substrate 2 does not vibrate and only the second substrate 4 vibrates. Even when only the first substrate 2 vibrates or both the substrates 2 and 4 vibrate, the vibration can be absorbed in the same manner.

Figure 17A:
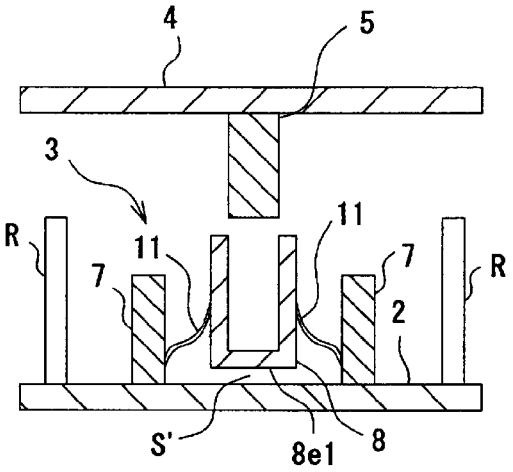
FIG. 17A is a schematic diagram of the plug connector of FIG. 1 and the socket connector of FIG. 6 before engagement.

In the electric connector 1 of the present embodiment, a gap S' is provided between the movable housing 8 and the first substrate 2 before engagement (see FIG. 17A). Then immediately after the start of the engaging operation, a load produced in the mating direction by contact with the plug contact portions 11*e* is applied through the socket contact portions 10*c* to the movable parts 11*c*, which are elastically deformed toward the first substrate 2 (see FIG. 17B). Then, when the abutting portions 8*e*1 of the movable housing 8 are brought into contact with the first substrate 2 or the movable parts 11*c* are elastically deformed until they can be deformed no further, the movable housing 8 is elastically displaced toward the first substrate 2. In this state, the first substrate 2 has a spacer R thereon, and the second substrate 4 is secured in place when it comes into contact with the spacer R (see FIG. 17B). In this case, almost no gap is left between the movable housing 8 and the first substrate 2, or the movable parts 11*c* are elastically deformed until they can be deformed no further. In this state, it is difficult for the movable housing 8 to be elastically displaced toward the first substrate 2 unless the second substrate 4 is deformed in the direction away from the movable housing 8 along the height direction Z. On the other hand, an engagement gap S2 is created between the socket connector 5 and the plug connector 3 in the height direction Z. With the engagement gap S2, the movable housing 8 is elastically deformed more easily toward the second substrate 4 than toward the first substrate 2 in the height direction Z. That is, the movable housing 8 is elastically deformed more easily in the direction of narrowing the engagement gap S2. In this state, the plug contact portions 11*e* are in electrical contact with the socket contact portions 10*c* at initial contact positions P1 (see FIG. 19) ("initial engaged state" illustrated in FIG. 17B).

In the engaged state of the connectors 3 and 5, the spacer R is positioned between the substrates 2 and 4 opposite each other, and a substrate interconnection structure S is formed by keeping the distance between the substrates 2 and 4 constant. When the second substrate 4 is brought into contact with the spacer R on the first substrate 2 and secured to the spacer R, the engaging operation described above is completed. The initial contact positions P1 described above refer to positions where the contact portions 10*c* and 11*e* are in contact with each other in this state. When the connectors 3 and 5 on the substrates 2 and 4 are brought into engagement, the engagement position of the connectors 3 and 5 can be adjusted by varying the length of the spacer R, and thus the initial contact positions P1 and the normal contact positions P2 (described below) can also be adjusted.

Then, if the second substrate 4 resonates, although the distance between the substrates 2 and 4 does not change in the area where the spacer R is located, the second substrate 4 may significantly vibrate and warp in the other area, and this may change the distance between the substrates 2 and 4. In this case, when the second substrate 4 warps once toward the first substrate 2 to reach the position of a second substrate 4', the socket connector 5 is displaced toward the first substrate 2 in response to this movement. Thus, the socket connector 5 and the plug connector 3 are relatively displaced to be engaged with each other at a deeper position (see FIG. 17C). That is, since the socket connector 5 is secured to the second substrate 4 and the movable housing 8 is in contact with the first substrate 2, reducing the distance between the first substrate 2 and the second substrate 4 causes the abutting portions 8*e*1 of the movable housing 8 to be pressed in by the fixed housing 7, and thus the socket connector 5 and the plug connector 3 are relatively displaced for engagement at a deeper position. As described above, in the "initial engaged state", the engagement gap S2 is created between the socket connector 5 and the plug connector 3 in the height direction Z. Thus, the socket connector 5 is relatively displaced toward the interior of the engagement chamber 8*d* of the plug connector 3, and this makes the engagement gap S2 smaller ("vibration bottom dead center state" illustrated in FIG. 17C). In this state, in the engagement chamber 9*e*, the plug contact portions 11*e* and the socket contact portions 10*c* move from the initial contact positions P1 to the normal contact positions P2 while sliding with respect to each other. Thus, after the substrates 2 and 4 once vibrate in the direction toward each other, the pressure contact state between the plug contact portions 11*e* and the socket contact portions 10*c* is maintained at the normal contact positions P2.

Figure 17B:
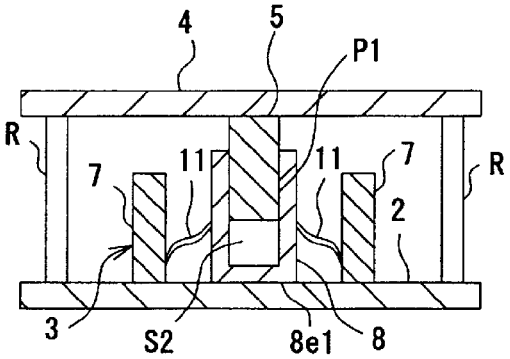
FIG. 17B is a schematic diagram of the same in an initial engaged state.
Figure 17C:
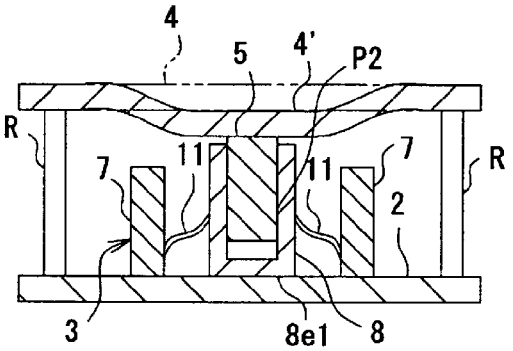
FIG. 17C is a schematic diagram of the same in a vibration bottom dead center state.
Figure 17D:
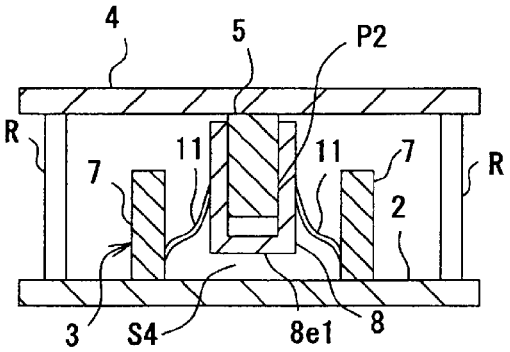
FIG. 17D is a schematic diagram of the same in an engaged state.

Then, in reaction to the vibration, the second substrate 4 returns to the same flat state as before the vibration and is kept in this state for only a short time ("engaged state" illustrated in FIG. 17D). In this case, the socket connector 5 is displaced in the direction away from the first substrate 2 in response to this movement. In the present embodiment, the load required for elastic deformation of the movable parts 11*c* in the mating and unmating directions is smaller than the load required for positional displacement of the plug contact portions 11*e* and socket contact portions 10*c*. Therefore, the socket contact portions 10*c* are elastically deformed in the extending direction of the movable parts 11*c* while being in contact with the plug contact portions 11*e* at the normal contact positions P2 without positional displacement therefrom. Thus, the movable housing 8 is displaced upward in the height direction Z relative to the fixed housing 7. The movable housing 8 is thus floated from the first substrate 2, and a movement gap S4 is created between the movable housing 8 and the first substrate 2. In this state, the movable housing 8 is not in contact with the substrates 2 and 4, and hangs down with the retaining force of the socket contact portions 10*c*. Therefore, the movable housing 8 can be elastically displaced toward the first substrate 2.

Then, the second substrate 4 warps in the direction away from the first substrate 2 to reach the position of a second substrate 4". In response to this movement, the socket connector 5 is displaced in the direction away from the first substrate 2. In this case, the plug contact portions 11*e* follow the socket contact portions 10*c* while being in contact with the socket contact portions 10*c* at the normal contact positions P2 without positional displacement therefrom. The movable housing 8 is displaced upward toward the second substrate 4. This further widens the movement gap S4 between the movable housing 8 and the first substrate 2 ("vibration top dead center state" illustrated in FIG. 17E).

Figure 17E:
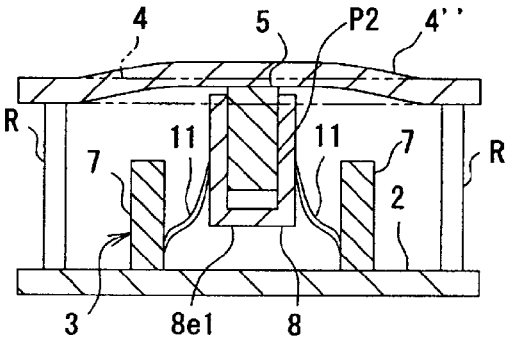
FIG. 17E is a schematic diagram of the same in a vibration top dead center state.
Figure 17F:
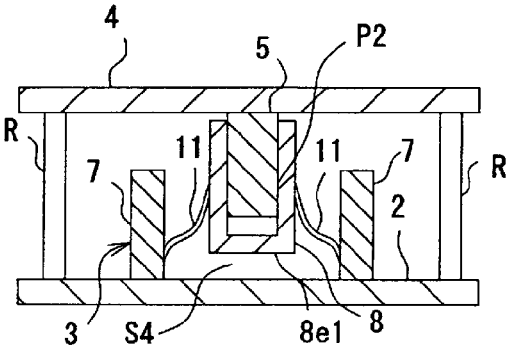
FIG. 17F is a schematic diagram of the same in an engaged state.

As described above, in the initial stage of the engaging operation, a transition from the state of FIG. 17A to the "initial engaged state" of FIG. 17B takes place. After the second substrate 4 once vibrates toward the first substrate 2 by resonance ("vibration bottom dead center state" illustrated in FIG. 17C), the second substrate 4 vibrates and the "engaged state" illustrated in FIG. 17D and the "vibration top dead center state" illustrated in FIG. 17E are reached. Then, the process of returning from the "engaged state" (see FIGS. 17D and 17F) to the "vibration bottom dead center state" (see FIG. 17C) is repeated. That is, the plug contact portions 11*e* and the socket contact portions 10*c* slide with respect to each other only once in the transition from the "initial engaged state" to the "engaged state". After that, it is possible to absorb large vibration in the height direction Z caused by resonance of the substrates 2 and 4 and maintain a stable contact state without occurrence of sliding and positional displacement.

The "initial engaged state", "vibration bottom dead center state", "engaged state", and "vibration top dead center state" will now be specifically described with reference to cross-sectional views of the electric connector 1.

Figure 5:
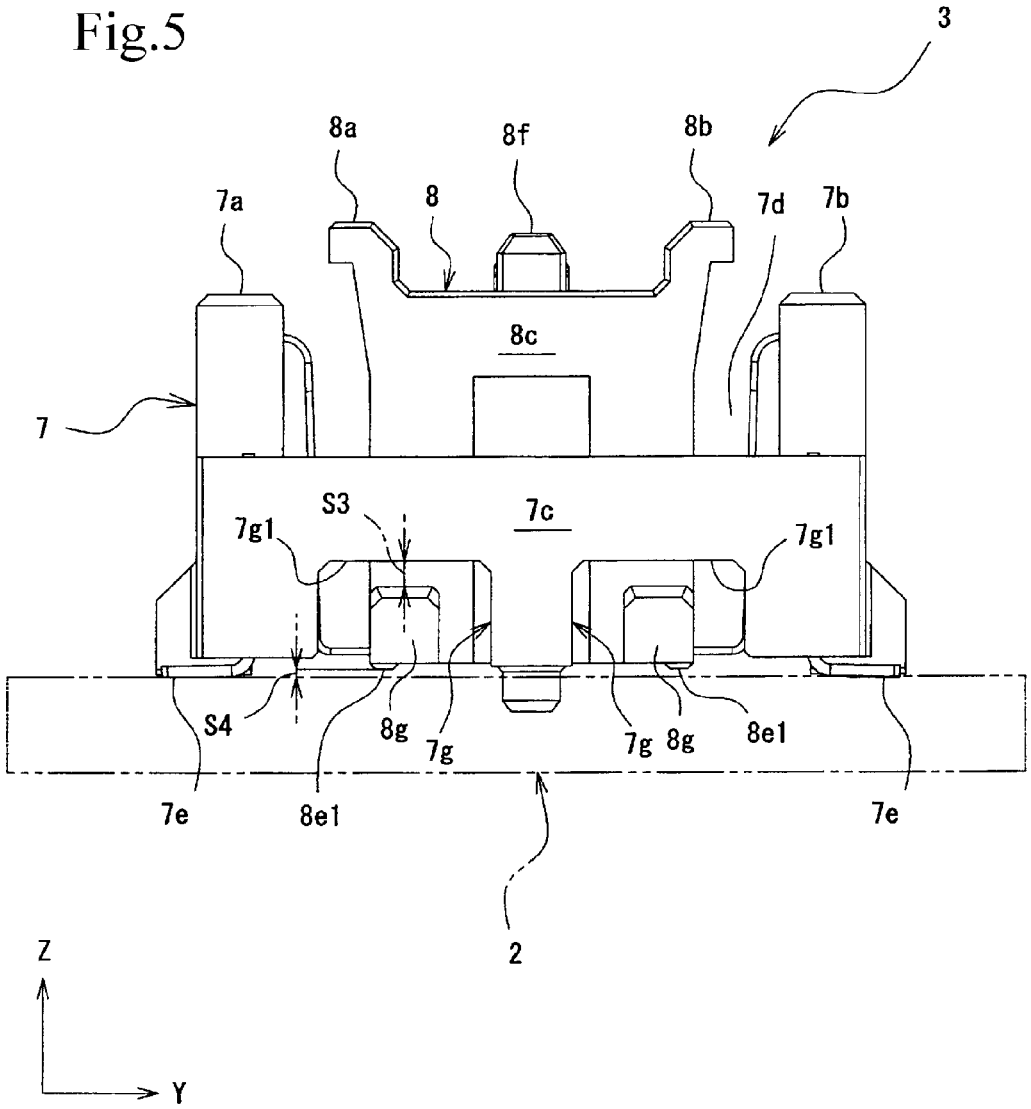
FIG. 5 is a right side view of the plug connector illustrated in FIG. 1.

Before engagement, a gap is provided between the movable housing 8 and the first substrate 2 (see FIG. 18). However, in the engaging operation, the movable housing 8 is pressed by the socket connector 5 toward the first substrate 2. Thus, in the "initial engaged state" (immediately after the engaging operation) where the plug connector 3 is engaged with the socket connector 5, the movable housing 8 is in contact with the first substrate 2 and almost no gap is left between them. In the "initial engaged state", an engagement gap S1 is created between the end portion 8*f*1 of the engagement wall 8*f* of the plug connector 3 and a bottom portion 9*e*1 of the engagement chamber 9*e* in the socket housing 9 (see FIG. 19). Also in this state, the engagement gap S2 is created between the top portion 9*d* of the socket housing 9 and a bottom portion 8*d*1 of the engagement chamber 8*d* in the movable housing 8 of the plug connector 3 (see FIG. 19). Additionally, an engagement gap S3 is created between the upper end of each locking portion 8*g* and the inner edge 7*g*1 of the corresponding recessed portion 7*g* (see FIG. 5). Note that the electric connector 1 illustrated in FIG. 5 is in the "engaged state", and hence the engagement gap S3 of the electric connector 1 in the "initial engaged state" is longer in the height direction Z than that illustrated in FIG. 5.

The lengths of the engagement gaps S1 to S3 in the height direction Z are set longer than the maximum length by which the second substrate 4 can warp by resonance in the height direction Z. Thus, even when the second substrate 4 resonates and significantly deforms to reduce the distance between the second substrate 4 and the first substrate 2, the socket connector 5 and the plug connector 3 can be moved to narrow the engagement gaps S1 to S3, and can be sufficiently relatively displaced to be engaged with each other at a deeper position. Thus, a transition from the "initial engaged state" to the "vibration bottom dead center state" takes place (see FIGS. 19 and 20). During this transition, the contact portions 10*c* and 11*e* move from the initial contact positions P1 to the normal contact positions P2 while sliding with respect to each other. When both the substrates 2 and 4 resonate, the lengths of the engagement gaps S1 to S3 in the height direction Z are set longer than the sum of the maximum lengths by which the substrates 2 and 4 can warp by resonance in the height direction Z, whereby the same effect as above can be achieved.

In the "vibration bottom dead center state", the contact portions 10*c* and 11*e* are in electrical contact with each other at the normal contact positions P2. In this state, the movable housing 8 is in contact with the first substrate 2, and almost no gap is left between them (see FIG. 20). Also, the engagement gaps S1 to S3 are shortened by the length by which the second substrate 4 warps toward the first substrate 2.

Figure 20:
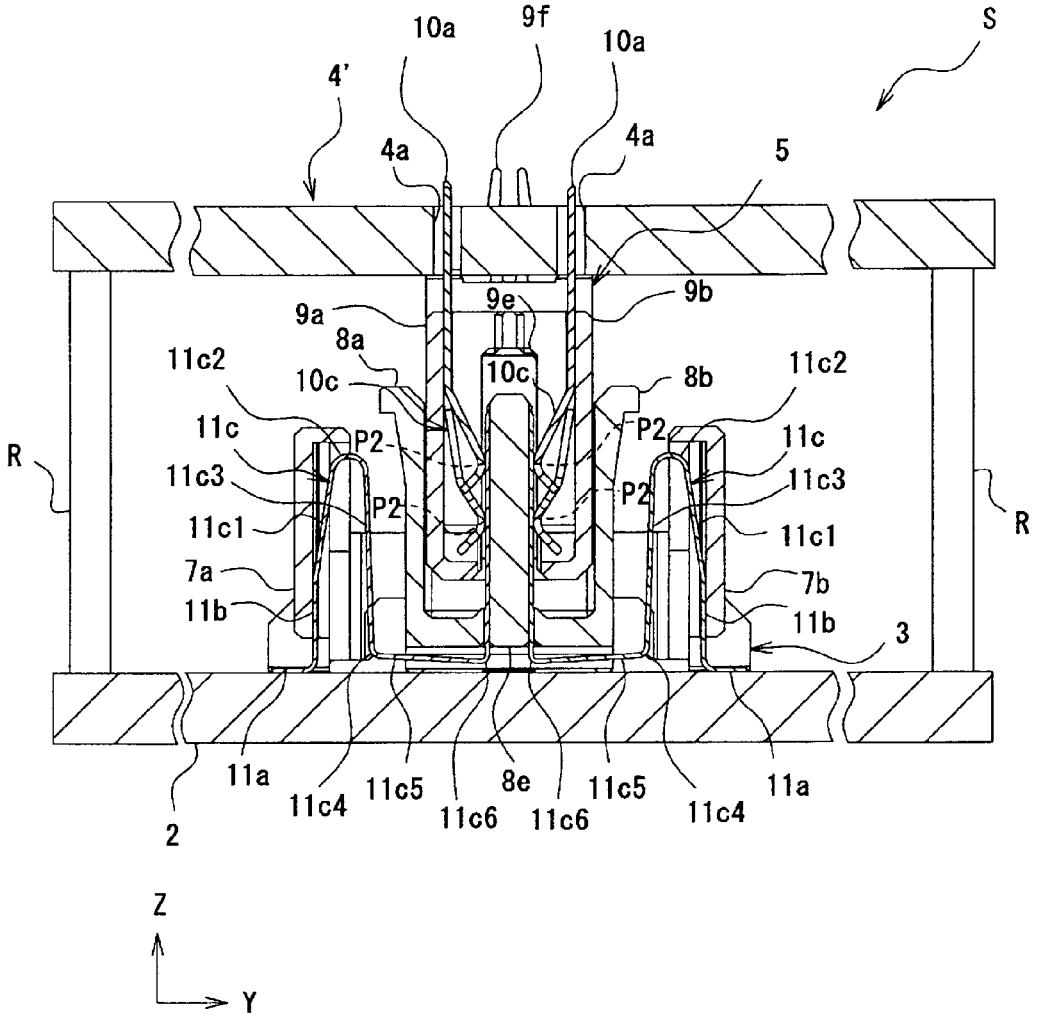
FIG. 20 is a cross-sectional view of the plug connector of FIG. 1 and the socket connector of FIG. 6 in a vibration bottom dead center state.

The transition from the "vibration bottom dead center state" to the "engaged state" takes place when the second substrate 4 is deformed in the direction away from the first substrate 2 (see FIG. 21). In this case, when the socket connector 5 is displaced in the direction away from the first substrate 2, the movable housing 8 follows the displacement of the socket connector 5 and is floated from the first substrate 2. The movement gap S4 is created between the lower end of each locking portion 8*g* and the surface of the first substrate 2 (see FIGS. 5 and 21). The movement gap S4 is not provided in the "initial engaged state" and the "vibration bottom dead center state", and is created in the "engaged state". In the "initial engaged state" and the "vibration bottom dead center state", the movable housing 8 is in contact with the first substrate 2 and no gap is created between them. The movement gap S4 is created only after the second substrate 4 in the vibration bottom dead center state is deformed in the direction away from the first substrate 2 and the movable housing 8 is displaced toward the second substrate 4 as described above. With the movement gap S4, the movable housing 8 can be relatively displaced toward the first substrate 2. Therefore, when, in this state, the socket connector 5 is relatively displaced toward the plug connector 3 (i.e., in the mating direction), the movable parts 11*c* are elastically deformed in the mating direction, whereby it is possible to maintain the pressure contact between the plug contact portions 11*e* and the socket contact portions 10*c* at the normal contact positions P2 without positional displacement therebetween (FIGS. 20 and 21).

In the "engaged state", when the second substrate 4 is deformed in the direction away from the first substrate 2, the socket connector 5 is displaced in the direction away from the first substrate 2 in response to the deformation of the second substrate 4, and hence the socket contact portions 10*c* are displaced in the same direction as the second substrate 4. The plug contact portions 11*e* follow the displacement of the socket contact portions 10*c* while being in electrical contact therewith at the normal contact positions P2 without positional displacement therefrom. The movable housing 8 follows the movement of the plug contact portions 11*e* and is relatively displaced to be floated ("vibration top dead center state" illustrated in FIG. 22). Then, when the second substrate 4 is deformed again toward the first substrate 2, the electric connector 1 returns to the "engaged state" (see FIG. 21). After that, when the second substrate 4 is deformed by vibration caused by resonance, the "vibration bottom dead center state", "engaged state", and "vibration top dead center state" are repeated. Thus, by elastic deformation of the movable parts 11*c*, the contact portions 10*c* and 11*e* can maintain their contact state at the normal contact positions P2 without sliding with respect to each other.

As described above, the electric connector 1 of the present embodiment can absorb vibration in the height direction Z, as well as in the width direction X and the front-back direction Y, without wear of the plug terminals 11 and the socket terminals 10. Therefore, the electric connector 1 can be used for components which particularly require resistance to vibration, such as automotive electrical components, and can achieve high connection reliability. Even if a particularly large vibration is produced by resonance of the substrates 2 and 4, the electric connector 1 can easily absorb the vibration.

Figure 23:
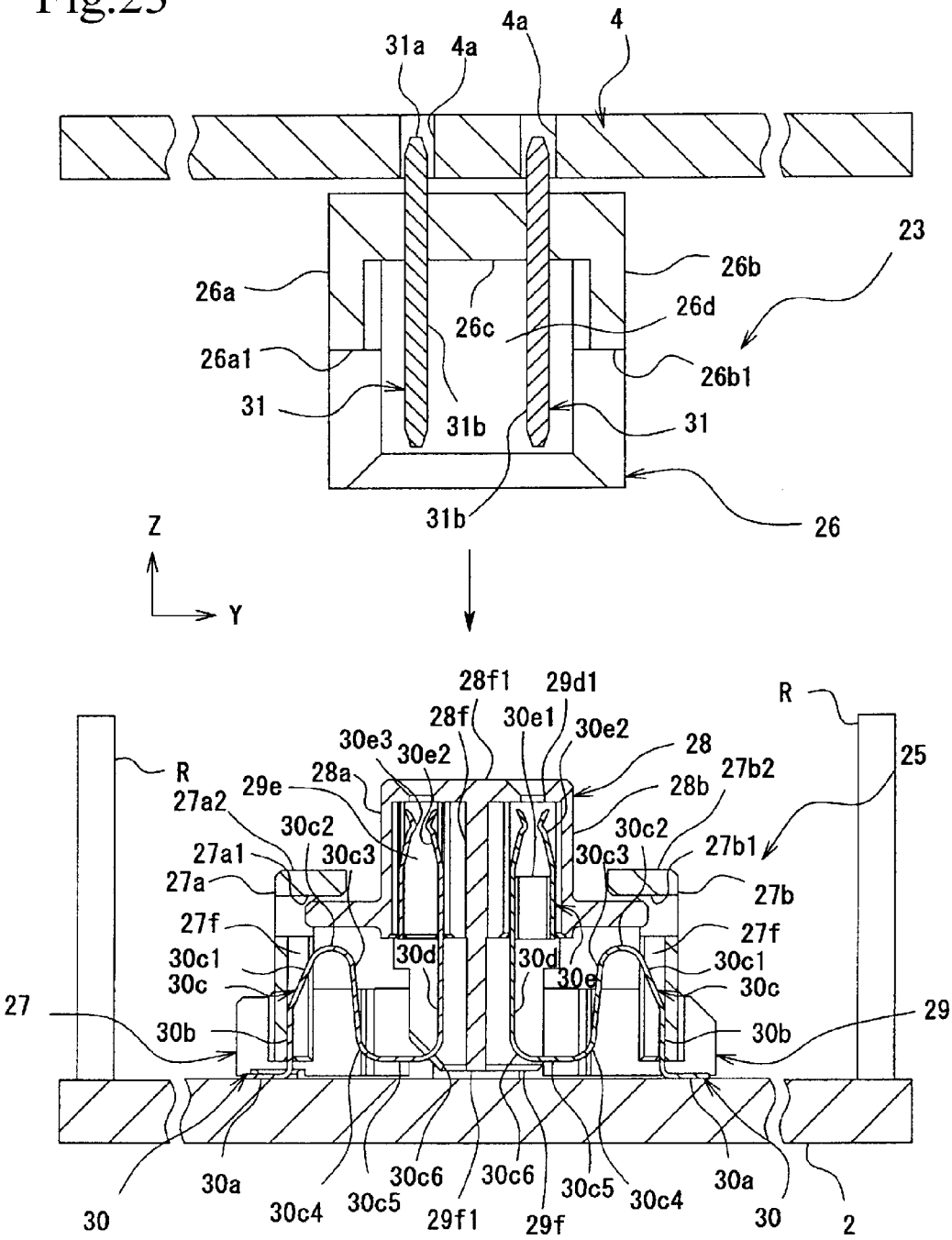
FIG. 23 is a cross-sectional view of a plug connector and a socket connector according to a second embodiment before engagement.
Figure 24:
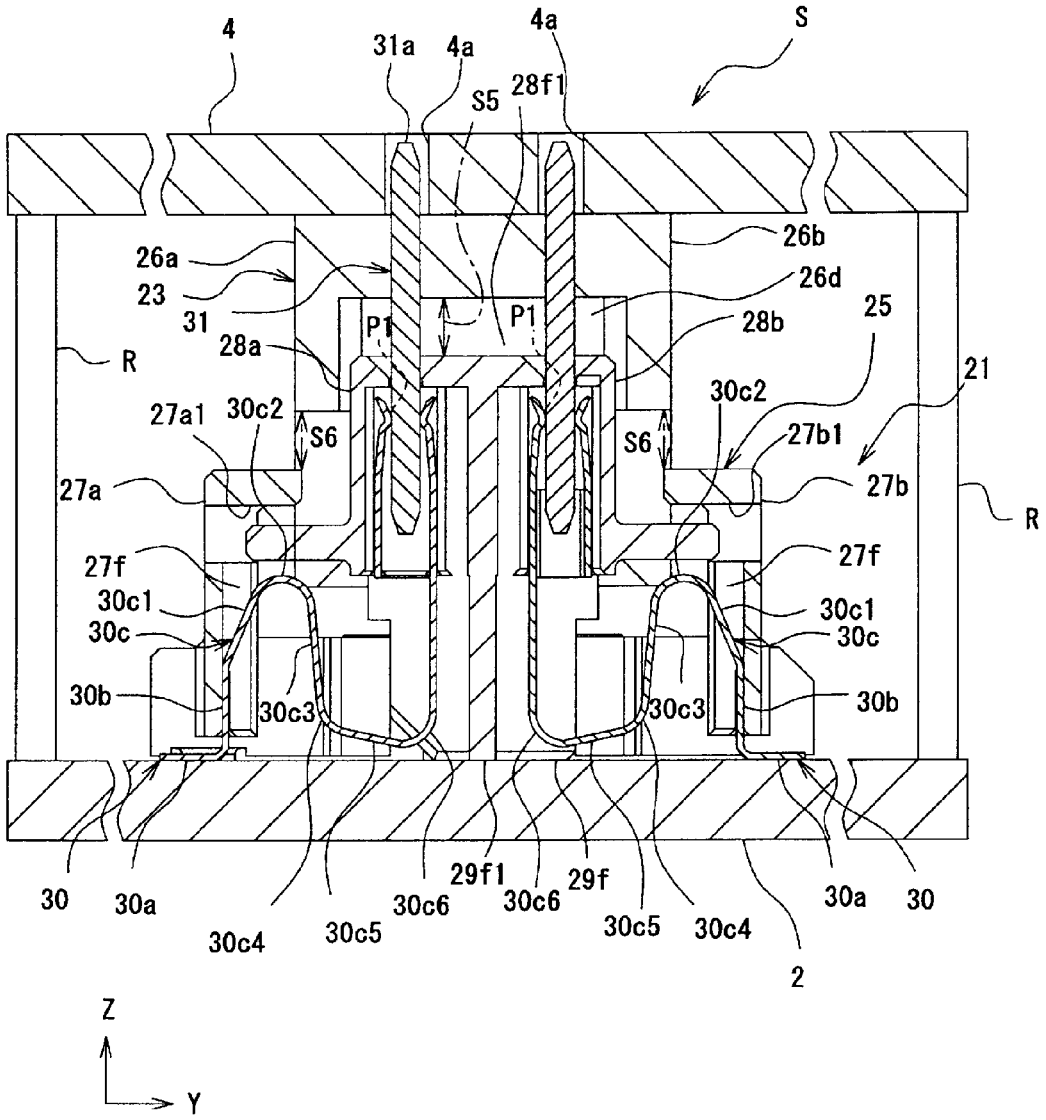
FIG. 24 is a cross-sectional view of the plug connector and the socket connector of FIG. 23 in an initial engaged state.
Figure 25:
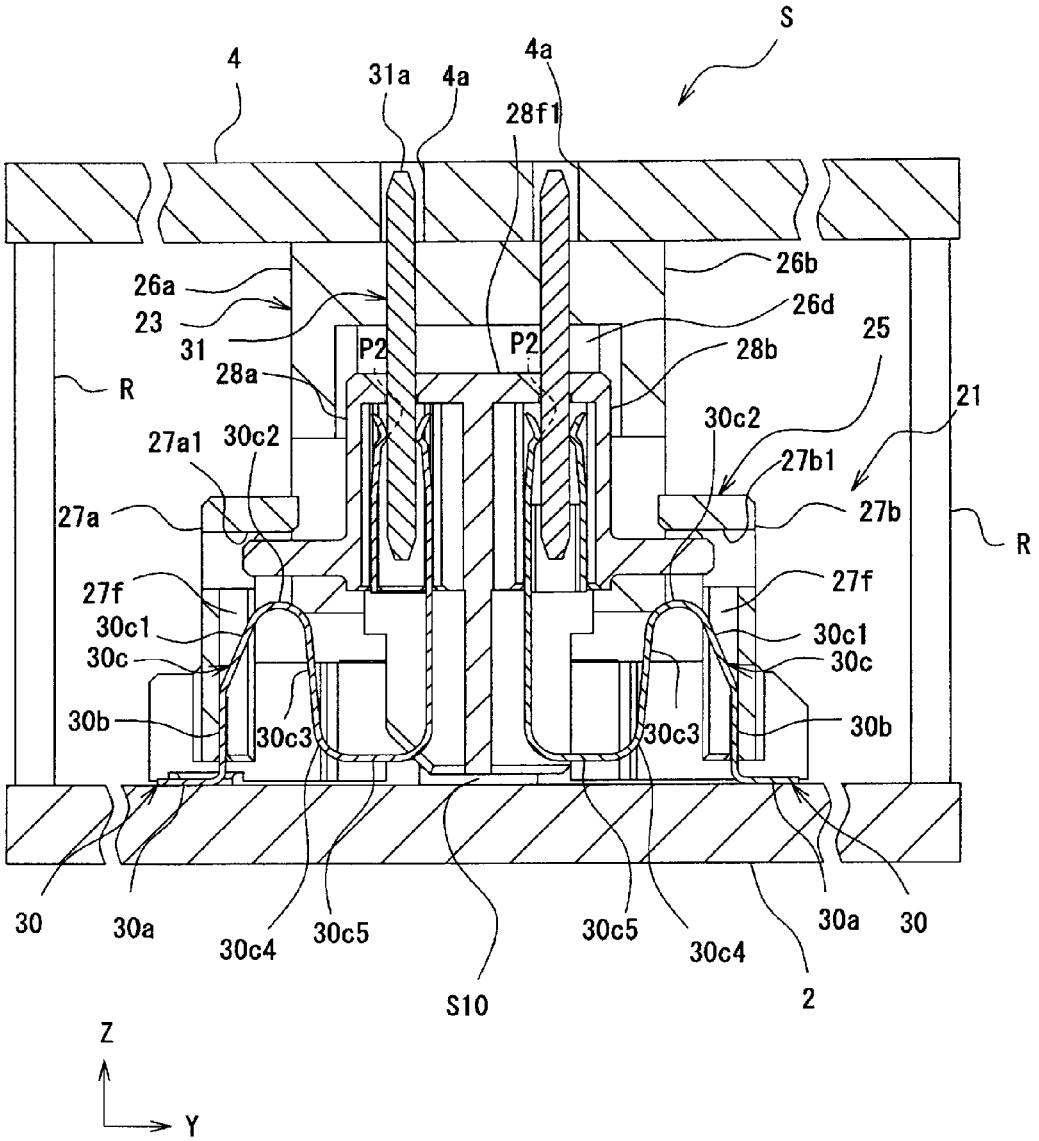
FIG. 25 is a cross-sectional view of the plug connector and the socket connector of FIG. 23 in an engaged state.

Second Embodiment (FIGS. 23 to 25)

The first embodiment describes the electric connector 1 in which the plug terminals 11 have the movable parts 11*c*. An electric connector 21 according to a second embodiment includes a socket connector 25 serving as a "first connector" secured to the first substrate 2, and a plug connector 23 serving as a "second connector" secured to the second substrate 4. The socket connector 25 includes a socket housing 29 including a fixed housing 27 serving as a "substrate-side housing" and a movable housing 28 serving as an "engagement-side housing", and socket terminals 30 each serving as a "first terminal" having a movable part 30*c* serving as a "movable piece".

Also, the first embodiment describes the electric connector 1 in which the front contact point 13*a* and the rear contact point 12*a* of each socket terminal 10 are brought into electrical contact with the corresponding plug terminal 11 from one side. On the other hand, in the electric connector 21, a plurality of contact points 30*e*3 of each socket terminal 30 are brought into electrical contact with the corresponding plug terminal 31 from both sides. A specific configuration of the plug connector 23 and the socket connector 25 will now be described.

(Plug Connector)

The plug connector 23 is a DIP connector and is secured to the second substrate 4. The plug connector 23 includes a plug housing 26 and plug terminals 31 each serving as a "second terminal".

(Plug Housing)

The plug housing 26 is a molded component of insulating resin, and is in the shape of a box which is open downward. The plug housing 26 has an engagement chamber 26*d* surrounded by a front portion 26*a*, a back portion 26*b*, and a bottom portion 26*c*.

(Plug Terminal)

The plug terminals 31 are each a pin-like terminal. Each plug terminal 31 has a substrate connection portion 31*a* to be inserted into the corresponding through hole 4*a* in the second substrate 4, and a plug contact portion 31*b* serving as a "first contact portion" to be pressed into contact with the corresponding socket terminal 30.

(Socket Connector)

The socket connector 25 is a surface mount connector. The socket connector 25 is secured by soldering to the planar surface of the first substrate 2. The socket connector 25 includes the socket housing 29 and the socket terminals 30.

(Socket Housing)

The socket housing 29 is a molded component of insulating resin, and includes the fixed housing 27 and the movable housing 28.

The fixed housing 27 is in the shape of a rectangular cylinder which is open at the top and bottom thereof. The fixed housing 27 has a front portion 27*a* and a back portion 27*b* each having a planar surface extending along the width direction X.

The front portion 27*a* and the back portion 27*b* have terminal accommodating holes 27*a*1 and 27*b*1 for securing the corresponding plug terminals 31. The terminal accommodating holes 27*a*1 and 27*b*1 are arranged in parallel, at regular intervals along the width direction X.

The movable housing 28 is in the shape of a box having a plurality of openings 29*d*1 at the top. The movable housing 28 has a front portion 28*a*, a back portion 28*b*, an engagement wall 28*f*, and a bottom portion 29*f*. The bottom portion 29*f* has an abutting portion 29*f*1 abutting against the first substrate 2 in the "initial engaged state" (see FIGS. 23 and 24).

The engagement wall 28*f* is in the shape of a flat plate extending along the X-Z plane. The engagement wall 28*f* is to be inserted into the engagement chamber 26*d* of the plug connector 23 from an end portion 28*f*1.

(Socket Terminal)

The socket terminals 30 are formed by bending a conductive metal sheet in the sheet thickness direction. In the socket housing 29, the socket terminals 30 are arranged in pairs along the front-back direction Y, with the engagement wall 28*f* interposed therebetween. The socket terminals 30 each have a substrate connection portion 30*a*, a fixed portion 30*b*, the movable part 30*c*, and a base end portion 30*d* configured in the same manner as the plug terminals 11 of the first embodiment. The movable part 30*c* has a first extending portion 30*c*1, a first bent portion 30*c*2, a second extending portion 30*c*3, a second bent portion 30*c*4, a third extending portion 30*c*5, and a third bent portion 30*c*6.

The socket terminals 30 of the present embodiment each have a socket contact part 30*e*. The socket contact part 30*e* extends upward from the base end portion 30*d* in the height direction Z. The socket contact part 30*e* has a coupling portion 30*e*1 connecting to the base end portion 30*d*, two elastic pieces 30*e*2 extending like a cantilever from the upper end of the base end portion 30*d*, and the contact points 30*e*3 elastically supported by the elastic pieces 30*e*2. The coupling portion 30*e*1 has a plurality of press-fit protrusions (not shown). The press-fit protrusions are engaged in press-fitted portions of the movable housing 28, whereby the socket terminals 30 are secured to the movable housing 28.

The opposite elastic pieces 30*e*2 and the opposite contact points 30*e*3 of each socket terminal 30 face each other along the front-back direction Y. The distance between the opposite contact points 30*e*3 is shorter than the length of each plug terminal 31 in the front-back direction Y. When the plug connector 23 is brought into engagement with the socket connector 25, the opposite contact points 30*e*3 are pressed further apart by the corresponding plug terminal 31. Thus, the plug terminals 31 are brought into electrical contact with the socket terminals 30 at the initial contact positions P1 ("initial engaged state" in FIG. 24). In this state, the opposite contact points 30*e*3 are pressed into contact with the plug terminal 31 with the same load, whereby the contact points 30*e*3 of each socket terminal 30 are brought into electrical contact with the corresponding plug terminal 31 sandwiched therebetween. Thus, the socket terminals 30 can be reliably brought into electrical contact with the plug terminals 31.

(Use Conditions)

As illustrated in FIG. 24, when the plug terminals 31 and the socket terminals 30 are in electrical contact at the initial contact positions P1 in the initial engaged state, an engagement gap S5 is provided between the bottom portion 26*c* of the plug housing 26 and the end portion 28*f*1 of the engagement wall 28*f* of the socket housing 29. In this state, an engagement gap S6 is provided between a lower end 26*a*1 of the front portion 26*a* of the plug housing 26 and an upper end 27*a*2 of the front portion 27*a* of the socket housing 29, and also between a lower end 26*b*1 of the back portion 26*b* of the plug housing 26 and an upper end 27*b*2 of the back portion 27*b* of the socket housing 29. The engagement gaps S5 and S6 are set longer than the maximum length by which the second substrate 4 can warp in the height direction Z. Thus, even when the substrates 2 and 4 resonate, the plug connector 23 and the socket connector 25 can be sufficiently relatively displaced in the direction of narrowing the engagement gaps S5 and S6 and engaged at a deep position ("engaged state" illustrated in FIG. 25). The engagement gaps S5 and S6 extend over substantially the entire length of the socket housing 29 in the width direction X.

Even though the plug housing 26 and the socket housing 29 are engaged with each other at a deep position, the contact portions 30*e* and 31*b* can move from the initial contact positions P1 to the normal contact positions P2 while sliding with respect to each other. In the "engaged state", a movement gap S10 is provided between the first substrate 2 and the abutting portion 29*f*1 of the movable housing 28. The movable parts 30*c* are elastically deformed in the mating direction of the connectors 23 and 25, and the movable housing 28 can be relatively displaced in the mating direction.

In the electric connector 21 of the present embodiment, each socket terminal 30 has the movable part 30*c* and the contact points 30*e*3 to be pressed into contact with the corresponding plug terminal 31. Thus, since the plug terminal 31 does not need to have a movable part, the structure of the plug terminal 31 can be simplified. Also, in the electric connector 21, each socket terminal 30 can easily follow the displacement of the corresponding plug terminal 31 and can easily maintain the electrical contact with the plug terminal 31.

Figure 26:
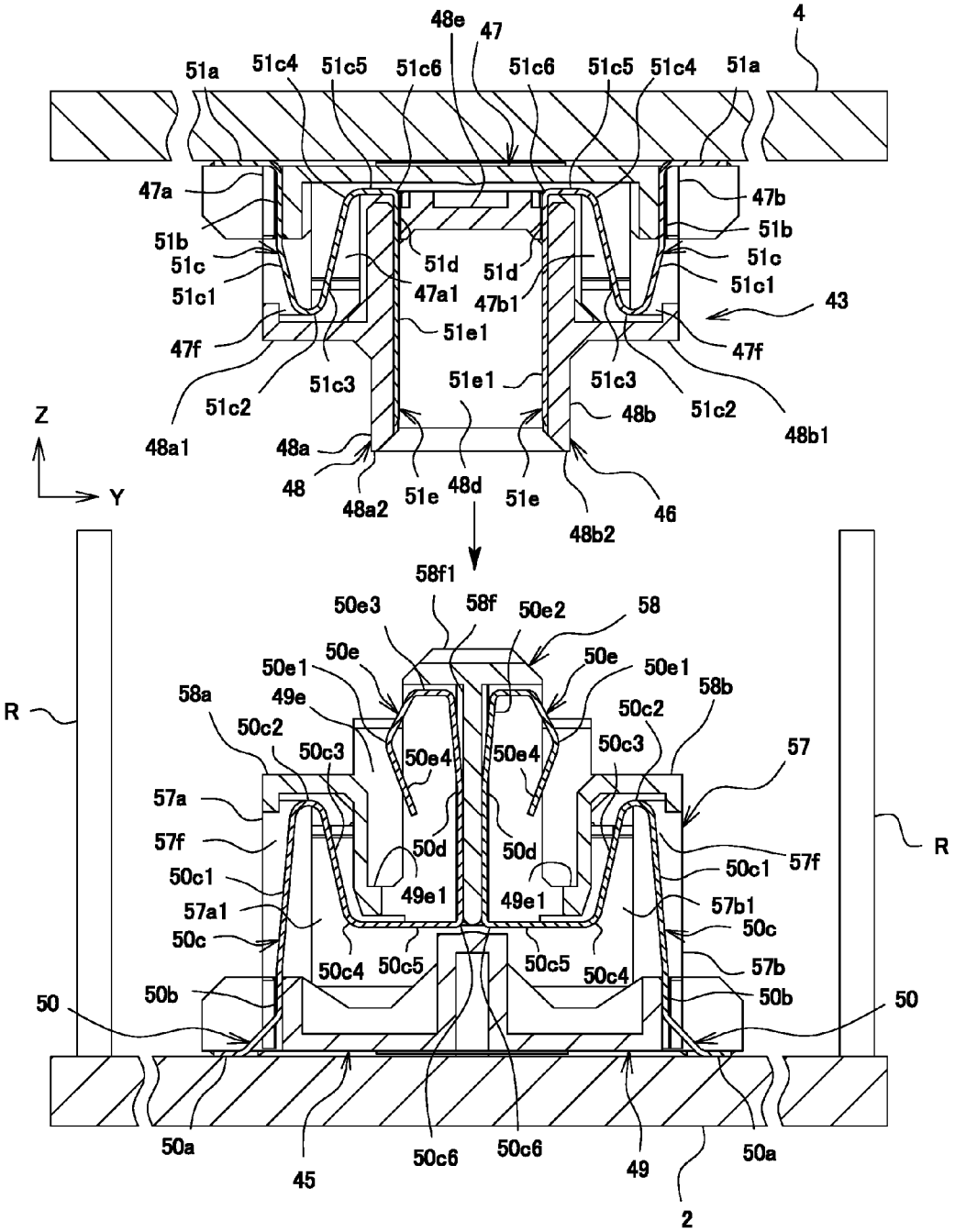
FIG. 26 is a cross-sectional view of a plug connector and a socket connector according to a third embodiment before engagement.
Figure 27:
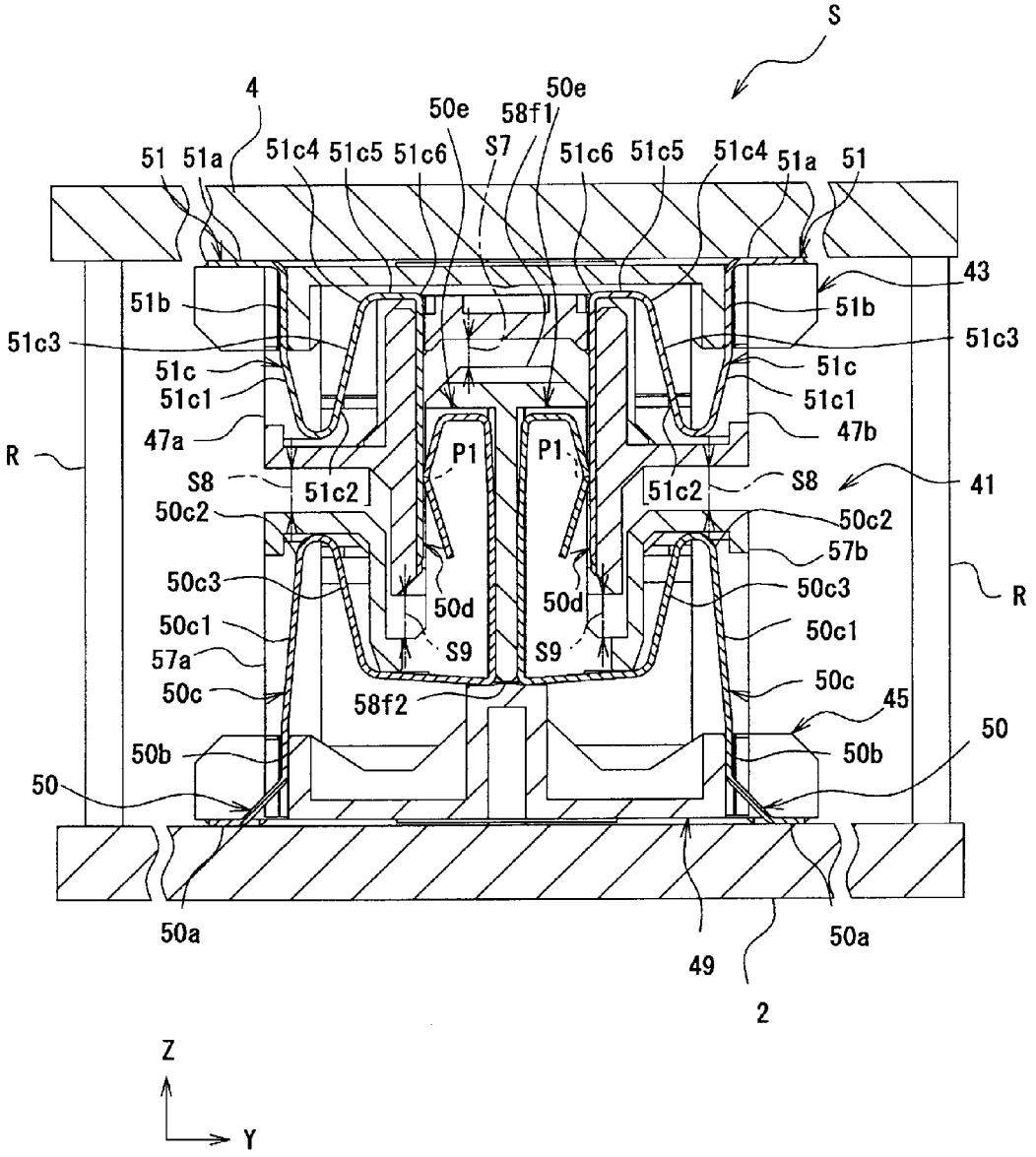
FIG. 27 is a cross-sectional view of the plug connector and the socket connector of FIG. 26 in an initial engaged state.
Figure 28:
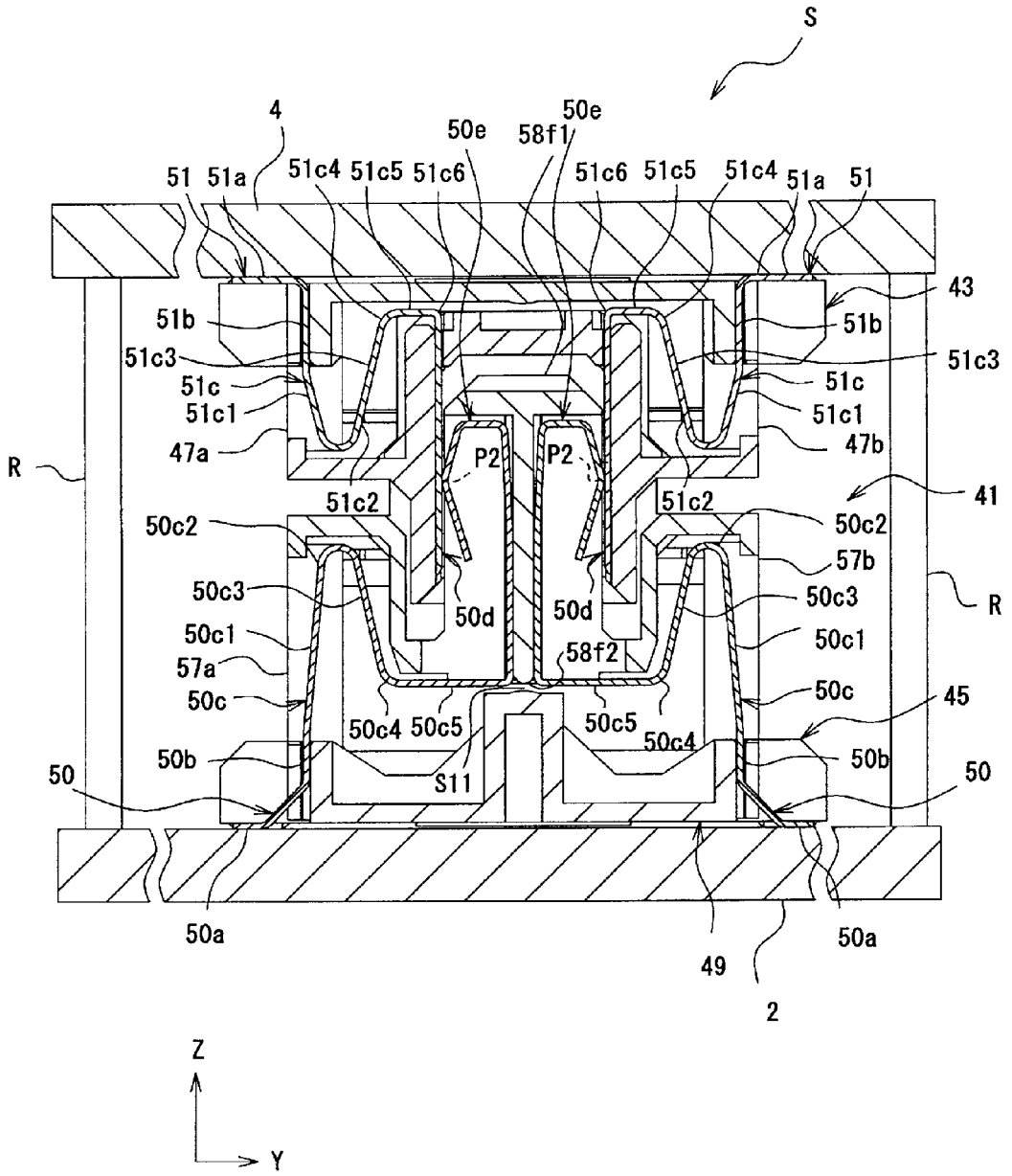
FIG. 28 is a cross-sectional view of the plug connector and the socket connector of FIG. 26 in an engaged state.

Third Embodiment (FIGS. 26 to 28)

The first and second embodiments provide the electric connectors 1 and 21 in which either the plug terminals or the socket terminals have movable parts. A third embodiment provides an electric connector 41 in which the plug terminals 51 and the socket terminals 50 have movable parts 51*c* and 50*c*, respectively. Thus, a large vibration can be fully absorbed by the movable parts 51*c* of the plug terminals 51 and the movable parts 50*c* of the socket terminals 50. Also, since the electric connector 41 has the movable parts 50*c* and 51*c*, the amount of movement required to absorb vibration can be distributed between the movable parts 50*c* and 51*c*. Therefore, as compared to the case where only the plug terminals or the socket terminals have movable parts, a load applied to each movable part can be reduced, and hence it is possible to reduce plastic deformation of and damage to the movable parts.

In the electric connector 41 of the present embodiment, a socket connector 45 has the socket terminals 50 retained by a socket housing 49, and a socket contact portion 50*e* of each socket terminal 50 has a contact point 50*e*1 protruding outward. A plug connector 43 of the present embodiment includes the plug terminals 51 facing each other and retained by a plug housing 46. The contact points 50*e*1 of the socket terminals 50 are inserted into the space between opposite plug contact portions 51*e* of the plug terminals 51, and pressed into electrical contact with the respective plug contact portions 51*e* in the direction from the center toward the outside in the front-back direction Y. A specific configuration of the socket connector 45 and the plug connector 43 will now be described.

(Socket Connector)

The socket connector 45 serving as a "first connector" is a surface mount connector, and is secured by soldering to the planar surface of the first substrate 2. The socket connector 45 includes the socket housing 49 and the socket terminals 50.

(Socket Housing)

The socket housing 49 is a molded component of insulating resin. The socket housing 49 includes a fixed housing 57 serving as a "substrate-side housing" and a movable housing 58 serving as an "engagement-side housing". The fixed housing 57 and the movable housing 58 have an engagement chamber 49*e* therebetween. A front portion 48*a* and a back portion 48*b* of a movable housing 48 of the plug connector 43 serving as a "second connector" or "connection object" are inserted into the engagement chamber 49*e*, where the socket terminals 50 are in electrical contact with the plug terminals 51.

The fixed housing 57 is in the shape of a box. The fixed housing 57 has a front portion 57*a* and a back portion 57*b* each having a planar surface extending along the width direction X.

The front portion 57*a* and the back portion 57*b* have terminal accommodating holes 57*a*1 and 57*b*1 for securing the corresponding fixed portions 50*b* of the socket terminals 50. The terminal accommodating holes 57*a*1 and 57*b*1 are arranged along the width direction X.

The movable housing 58 has an engagement wall 58*f* with planar surfaces extending along the X-Z plane. The engagement wall 58*f* has terminal grooves (not shown) for accommodating the socket contact portions 50*e* of the socket terminals 50. The movable housing 58 is inserted into an engagement chamber 48*d* of the plug connector 43 from an end portion 58*f*1 of the engagement wall 58*f*.

(Socket Terminal)

The socket terminals 50, each serving as a "first terminal", are formed by bending a conductive metal sheet in the sheet thickness direction. The socket terminals 50 each have a substrate connection portion 50*a*, the fixed portion 50*b*, the movable part 50*c*, and a base end portion 50*d* configured in the same manner as the socket terminals 30 of the second embodiment. The movable part 50*c* has a first extending portion 50*c*1, a first bent portion 50*c*2, a second extending portion 50*c*3, a second bent portion 50*c*4, a third extending portion 50*c*5, and a third bent portion 50*c*6.

The socket terminals 50 of the present embodiment each have the socket contact portion 50*e* serving as a "first contact portion". The socket contact portion 50*e* extends upward from the base end portion 50*d* in the height direction Z. The socket contact portion 50*e* has a vertical piece 50*e*2 extending along the engagement wall 58*f* in the height direction Z, a horizontal piece 50*e*3 extending toward the movable part 50*c* away from the base end portion 50*d* in the front-back direction Y, a bent portion 50*e*4 located on the lower side in the height direction Z and inclined toward the contact with the corresponding plug terminal 51, and the contact point 50*e*1 located at substantially the center of the inclined portion 50*e*4 in the height direction Z. In the third embodiment, the contact point 50*e*1 of each socket terminal 50 is pressed into contact with the corresponding contact surface 51*e*1 of the plug terminal 51 in the direction from the center toward the outside in the front-back direction Y.

In the socket housing 49, the socket terminals 50 are arranged in pairs along the front-back direction Y, with the engagement wall 58*f* interposed therebetween. The contact points 50*e*1 of each pair of socket terminals 50 are pressed into contact with the respective contact surfaces 51*e*1 of the corresponding pair of plug terminals 51 in the plug housing 46 with substantially the same load. The socket terminals 50 are thus reliably brought into electrical contact with the plug terminals 51 such that the socket terminals 50 support the plug terminals 51.

(Plug Connector)

The plug connector 43 serving as a "second connector" is a surface mount connector, and is secured by soldering to the planar surface of the first substrate 2. The plug connector 43 includes the plug housing 46 and the plug terminals 51.

(Plug Housing)

The plug housing 46 is a molded component of insulating resin. The plug housing 46 includes a fixed housing 47 and the movable housing 48.

The fixed housing 47 is in the shape of a rectangular cylinder which is open at the top and bottom thereof. The fixed housing 47 has a front portion 47*a* and a back portion 47*b* each having a planar surface extending along the width direction X. The fixed housing 47 has the engagement chamber 48*d* for insertion of the socket terminals 50 of the socket connector 45.

The front portion 47*a* and the back portion 47*b* have terminal accommodating holes 47*a*1 and 47*b*1 for securing the corresponding plug contact portions 51*e* of the plug terminals 51.

The movable housing 48 has the front portion 48*a*, the back portion 48*b*, and a bottom portion 48*e*. The front portion 48*a* and the back portion 48*b* have canopy-like portions 48*a*1 and 48*b*1, respectively, extending like a canopy in the front-back direction Y under the movable parts 51*c* of the plug terminals 51. A movement gap 47*f* for elastic deformation of the movable parts 51*c* is created between the canopy-like portion 48*a*1 of the movable housing 48 and the movable parts 51*c*, and also between the canopy-like portion 48*b*1 of the movable housing 48 and the movable parts 51*c*.

(Plug Terminal)

The plug terminals 51, each serving as a "second terminal", are formed by bending a conductive metal sheet in the sheet thickness direction. The plug terminals 51 each have a substrate connection portion 51*a*, a fixed portion 51*b*, the movable part 51*c*, a base end portion 51*d*, and the plug contact portion 51*e* configured in the same manner as the plug terminals 11 of the first embodiment. The movable part 51*c* has a first extending portion 51*c*1, a first bent portion

51*c*2, a second extending portion 51*c*3, a second bent portion 51*c*4, a third extending portion 51*c*5, and a third bent portion 51*c*6.

The plug terminals 51 of the present embodiment each have the plug contact portion 51*e*. The plug contact portion 51*e* has the contact surface 51*e*1 extending along the inner wall of one of the front portion 48*a* and the back portion 48*b* of the movable housing 48 of the plug housing 46, and facing the engagement chamber 48*d*. Each socket terminal 50 is pressed into contact with the corresponding contact surface 51*e*1 of the plug terminal 51 in the direction from the center toward the outside in the front-back direction Y. Thus, two socket terminals 50 arranged in a pair in the front-back direction Y can be brought into electrical contact with the respective plug terminals 51 at separate locations in the front-back direction Y such that the socket terminals 50 support the plug terminals 51, whereby the plug connector 43 is not easily inclined toward the socket connector 45 in the front-back direction Y. The electric connector 41 with high connection reliability can thus be provided.

(Use Conditions)

As illustrated in FIG. 27, when the plug terminals 51 and the socket terminals 50 are in electrical contact at the initial contact positions P1 in the "initial engaged state", an engagement gap S7 is provided between the bottom portion 48*e* of the plug housing 46 and the end portion 58*f*1 of the engagement wall 58*f* of the socket housing 49. In this state, an engagement gap S8 is provided between the canopy-like portion 48*a*1 of the front portion 48*a* of the plug housing 46 and a lower end 58*a* of the movable housing 58 of the socket housing 49, and also between the canopy-like portion 48*b*1 of the back portion 48*b* of the plug housing 46 and a lower end 58*b* of the movable housing 58 of the socket housing 49. Additionally, an engagement gap S9 is provided between a lower end 48*a*2 of the front portion 48*a* of the plug housing 46 and a bottom portion 49*e*1 of the engagement chamber 49*e* in the socket housing 49, and also between an upper end 48*b*2 of the back portion 48*b* of the plug housing 46 and the bottom portion 49*e*1 of the engagement chamber 49*e* in the socket housing 49.

The engagement gaps S7 to S9 are set longer than the maximum length by which the second substrate 4 can warp in the height direction Z. Thus, even when the substrates 2 and 4 resonate, the plug connector 43 and the socket connector 45 can be relatively displaced sufficiently in the direction of narrowing the engagement gaps S7 to S9 and engaged at a deep position ("engaged state" illustrated in FIG. 28).

Even though the plug connector 43 and the socket connector 45 are thus engaged with each other at a deep position, the contact portions 50*e* and 51*b* can move from the initial contact positions P1 to the normal contact positions P2 while sliding with respect to each other. In the "engaged state", a movement gap S11 is provided between an abutting portion 58*f*2 at the lower end of the engagement wall 58*f* of the movable housing 58 and the fixed housing 57. Thus, the movable parts 50*c* and 51*c* can be elastically displaced in the mating direction of the connectors 45 and 43, and the movable housing 58 can be relatively displaced in the mating direction.

In the electric connector 41 of the present embodiment, a load required for elastic deformation of the movable parts 50*c* of the socket connector 45 and the movable parts 51*c* of the plug connector 43 in the mating and unmating directions is smaller than the load required for relative positional displacement of the socket terminals 50 and the plug terminals 51 from the normal contact positions P2 in the mating and unmating directions. Therefore, when a vibration in the height direction Z is applied to the electric connector 41, the electrical contact between the socket terminals 50 and the plug terminals 51 can be maintained without relative positional displacement of the socket terminals 50 and the plug terminals 51 from the normal contact positions P2 until completion of elastic deformation of the movable parts 50*c* and 51*c* inside the housings 49 and 46.

In the electric connector 41 of the present embodiment, since a load produced by elastic deformation can be distributed between the movable parts 50*c* and 51*c*, it is possible to make the movable parts 50*c* and 51*c* resistant to breakage and damage.

Modification of Embodiments

The embodiments described above are merely examples of the present invention, and may be appropriately changed without departing from the scope of the present invention.

Although a contact portion of each socket or plug terminal has one or two contact points in the embodiments described above, the contact portion may have three or more contact points. This allows more reliable electrical contact with the other terminal. Also, with a greater number of contact points, the other terminal can be retained with a greater force. At the same time, since the retaining force for retaining the other terminal can be distributed among many contact points, it is possible to reduce wear of the contact portion between each contact point and the other terminal.

The embodiments described above provide the electric connectors 1, 21, and 41 that electrically connect the first substrate 2 and the second substrate 4. An alternate electric connector may be one that includes a connector having terminals with movable parts and contact points, and a housing configured to retain the terminals; and a connection object electrically connected to the connector and not secured to a substrate. In this case, a load required for elastic deformation of each movable part in the mating and unmating directions is set smaller than the load required for relative positional displacement of at least one of contact portions from the normal contact position P2 in the mating and unmating directions. This can reduce positional displacement caused by sliding between the terminals of the connector and the connection object. The connection object is not particularly limited, as long as it has connection contactors to be pressed into contact with the terminals of the connector.

In the embodiments described above, only the second substrate 4 vibrates by resonance. However, even when only the first substrate 2 vibrates or both the substrates 2 and 4 vibrate, the movable parts can be elastically deformed in the mating and unmating directions while the plug contact portions and the socket contact portions are in electrical contact with each other at the normal contact positions P2 without positional displacement.

In the embodiments described above, the load required for elastic deformation of the movable parts 11*c*, 30*c*, 50*c*, or 51*c* in the mating and unmating directions is smaller than the load required for positional displacement of the plug contact portions and the socket contact portions from the normal contact positions P2. Alternatively, the load required for relative elastic deformation of the movable parts in at least one of the mating and unmating directions may be smaller than the load for relative positional displacement of at least one of the plug contact portions and the socket contact portions from the normal contact positions P2 in the mating and unmating directions.

Figure 29:
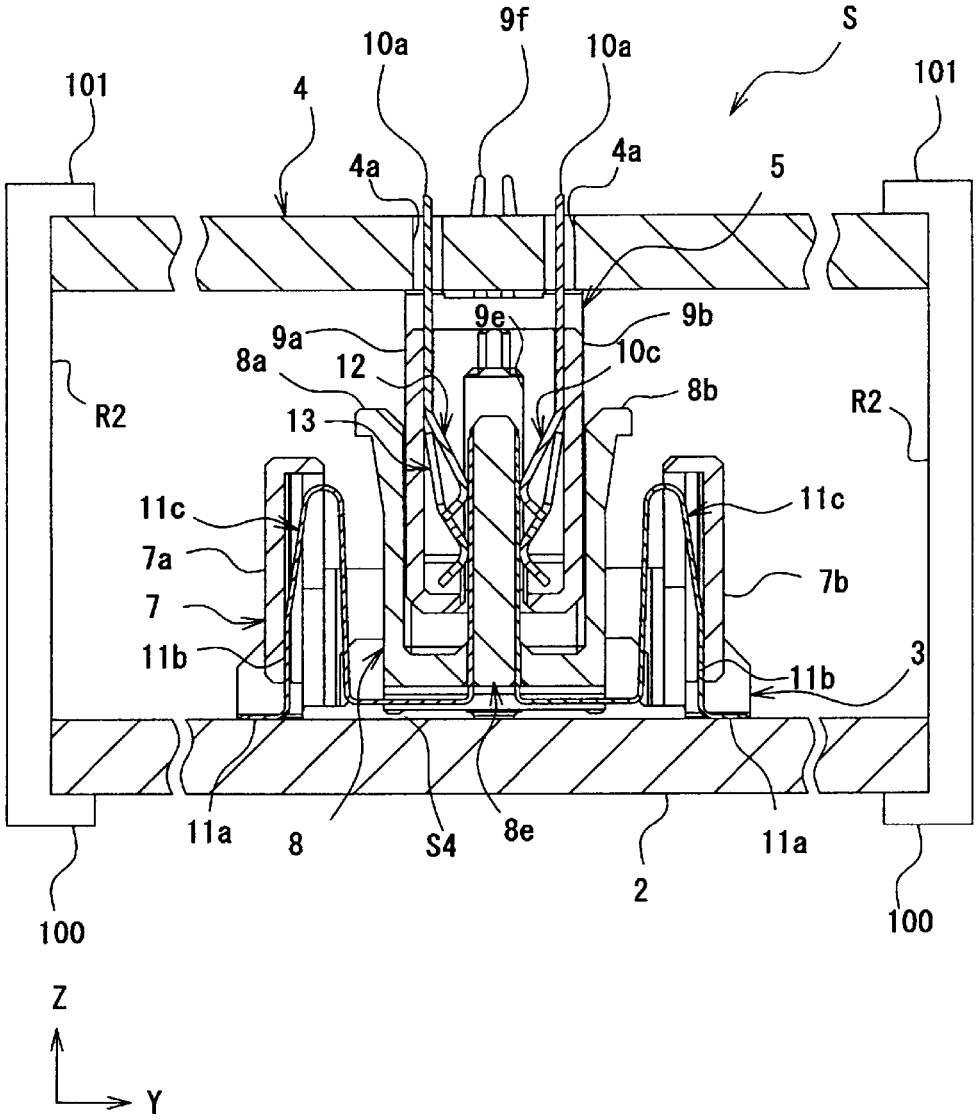
FIG. 29 is a cross-sectional view corresponding to FIG. 21 and illustrating a modified spacer.

In the embodiments described above, the spacer R is positioned between the substrates 2 and 4 to keep the distance therebetween constant. The spacer R is attached at both ends thereof to the opposite surfaces of the substrates 2 and 4. That is, the spacer R between the substrates 2 and 4 is attached at one end thereof to the surface having the connector 3, 25, or 45 thereon, and attached at the other end thereof to the surface having the connector 5, 23, or 43 thereon. However, the spacer R is not particularly limited, as long as it can keep the distance between the substrates 2 and 4 constant. For example, as illustrated in FIG. 29, a spacer R2 having a C-shaped cross section may be used. In this case, a first folded portion 100 at one end of the spacer R2 may be attached to a surface of the first substrate 2 opposite the surface having the connector 3, 25, or 45 thereon, and a second folded portion 101 at the other end of the spacer R2 may be attached to a surface of the second substrate 4 opposite the surface having the connector 5, 23, or 43 thereon. Thus, the substrates 2 and 4 can be disposed between the first folded portion 100 and the second folded portion 101, and the distance between the substrates 2 and 4 can be kept constant. Alternatively, a spacer having an L-shaped cross section (i.e., having only one folded portion) may be used. In this case, the folded portion of the spacer may be attached to a surface of the first substrate 2 opposite the surface having the connector 3, 25, or 45 thereon, and the other end of the spacer may be attached to the surface of the second substrate 4 having the connector 5, 23, or 43 thereon. Conversely, the folded portion of the spacer may be attached to the second substrate 4, and the other end of the spacer may be attached to the first substrate 2. The distance between the substrates 2 and 4 may be kept constant by securing the substrates 2 and 4 to a structure, such as a housing, using different mount members.

What is claimed is:

1. A substrate interconnection structure comprising:

a first substrate;

a second substrate disposed opposite the first substrate at a predetermined distance therefrom;

a connector secured to the first substrate; and a connection object secured to the second substrate, the connection object being electrically connected to the connector, wherein the connector includes an engagement-side housing engaged with the connection object, a substrate-side housing secured to the first substrate, and a first terminal having a first contact portion in electrical contact with the connection object engaged with the engagement-side housing and a movable piece elastically connecting the engagement-side housing to the substrate-side housing; and when at least one of the first substrate and the second substrate warps in engaging and disengaging directions of the connection object with respect to the engagement-side housing, the movable piece elastically supports the substrate-side housing displaced in response to movement of the first substrate, while maintaining the contact of the first contact portion with the connection object.

2. The substrate interconnection structure according to claim 1, wherein the engagement-side housing has an abutting portion configured to abut against the first substrate; and one of the engagement-side housing and the connection object has an engagement gap so that, when at least one of the first substrate and the second substrate warps in a direction of reducing the distance therebetween to cause the abutting portion of the engagement-side housing to be pressed in by the first substrate, the engagement-side housing and the connection object are engaged with each other at a deeper position.

3. The substrate interconnection structure according to claim 2, wherein the substrate interconnection structure has a movement gap between the first substrate and the engagement-side housing.

4. The substrate interconnection structure according to claim 2, wherein the substrate interconnection structure has a movement gap between the substrate-side housing and the engagement-side housing.

5. The substrate interconnection structure according to claim 2, wherein the movable piece elastically supports the substrate-side housing displaced when at least one of the first substrate and the second substrate warps in a direction of increasing the distance therebetween.

6. The substrate interconnection structure according to claim 2, wherein the movable piece elastically supports the substrate-side housing displaced when at least one of the first substrate and the second substrate warps in a direction of reducing the distance therebetween.

7. The substrate interconnection structure according to claim 1, wherein the engagement-side housing has an abutting portion configured to abut against the substrate-side housing; and one of the engagement-side housing and the connection object has an engagement gap so that, when at least one of the first substrate and the second substrate warps in a direction of reducing the distance therebetween to cause the abutting portion of the engagement-side housing to be pressed in by the substrate-side housing, the engagement-side housing and the connection object are engaged with each other at a deeper position.

8. The substrate interconnection structure according to claim 7, wherein the substrate interconnection structure has a movement gap between the substrate-side housing and the engagement-side housing.

9. The substrate interconnection structure according to claim 7, wherein the movable piece elastically supports the substrate-side housing displaced when at least one of the first substrate and the second substrate warps in a direction of increasing the distance therebetween.

10. The substrate interconnection structure according to claim 7, wherein the movable piece elastically supports the substrate-side housing displaced when at least one of the first substrate and the second substrate warps in a direction of reducing the distance therebetween.

* * * * *